US012599253B1

(12) United States Patent
Glaser

(10) Patent No.: US 12,599,253 B1
(45) Date of Patent: Apr. 14, 2026

(54) COLLAPSIBLE BAR ASSEMBLY

(71) Applicant: Kayla Glaser, Ocala, FL (US)

(72) Inventor: Kayla Glaser, Ocala, FL (US)

( * ) Notice: Subject to any disclaimer, the term of this patent is extended or adjusted under 35 U.S.C. 154(b) by 232 days.

(21) Appl. No.: 18/502,687

(22) Filed: Nov. 6, 2023

Related U.S. Application Data

(60) Provisional application No. 63/470,610, filed on Jun. 2, 2023.

(51) Int. Cl.
*A47B 43/00* (2006.01)
*A47F 9/00* (2006.01)

(52) U.S. Cl.
CPC ..... *A47F 9/00* (2013.01); *A47B 43/00* (2013.01)

(58) Field of Classification Search
CPC ..... A47B 43/00; A47F 9/00
USPC ..... 312/244, 240, 140.1, 140.2
See application file for complete search history.

(56) References Cited

U.S. PATENT DOCUMENTS 1,943,282 A * 1/1934 Bellavia ..... A47B 17/036 312/316
2,406,237 A * 8/1946 Milkoff ..... A47B 3/10 190/11
2,411,620 A * 11/1946 English ..... A47B 43/02 312/140.2
2,764,462 A 9/1956 Mcdonald
3,070,416 A * 12/1962 Post ..... A47B 43/02 108/14
3,140,133 A 7/1964 Kraft
(Continued)

*Primary Examiner* — James O Hansen
(74) *Attorney, Agent, or Firm* — John Rizvi; John Rizvi, P.A.—The Patent Professor®

(57) ABSTRACT

A bar assembly includes, in combination, a foldable counter and a pair of support legs arranged to support the counter in a table-type formation. Each support leg is configured as an open-sided, rectangular-shaped enclosure. The support legs are positioned in an upright, standing orientation to support the counter. The counter includes a set of openings, each adapted to receive a removable sink-type basin. A faucet is associated with one of the sink-type basins. A rear panel removably extends between the pair of upright support legs at a rear bar area manned by a bartender. A rear speed rail receptacle is removably attached to the rear panel. An arrangement of front panels removably extends between the pair of support legs at a front customer service bar area. One of the front panels includes a central panel section extending above the counter at its periphery, and a pair of pivotable end panel sections each hingedly attached to the central panel section. A foldable elevated shelf is disposed over the counter and supported by the end panel sections once they are pivoted into a shelf-supporting position. A water supply system uses a foot-powered pump to communicate water selectively and manually from a water-holding receptacle to the faucet via hoses. The pair of support legs define joinable half sections together forming a selectively openable and closeable case defining a storage space. In a stowage configuration, the bar assembly is disassembled, and various components are stowed in the storage space of the case, including the folded counter, the folded shelf, the rear panel, the rear speed rail receptacle, the basins, and the arrangement of front panels. One of the half sections of the case includes a set of wheels and a handle to facilitate portability and mobility.

19 Claims, 19 Drawing Sheets

(56) References Cited

U.S. PATENT DOCUMENTS

| | | | | | |
|---|---|---|---|---|---|
| 3,949,902 | A * | 4/1976 | Thompson | B67D 1/0007 | 222/626 |
| 3,983,583 | A * | 10/1976 | Herman | A47B 69/00 | 62/331 |
| 5,251,790 | A * | 10/1993 | Cohn | B67D 1/06 | 62/390 |
| 5,382,087 | A | 1/1995 | Pouch | | |
| 5,526,539 | A * | 6/1996 | Bower | A45D 19/04 | 312/317.3 |
| 5,702,115 | A * | 12/1997 | Pool | A61G 12/001 | 280/47.35 |
| 5,915,602 | A * | 6/1999 | Nelson | A47F 9/00 | 108/143 |
| 6,561,599 | B2 * | 5/2003 | Itakura | A47B 46/00 | 312/205 |
| 7,425,046 | B2 * | 9/2008 | DeMars | A47B 77/10 | 312/258 |
| 7,780,250 | B2 * | 8/2010 | Knowles | A47B 69/00 | 312/140.2 |
| 8,490,551 | B1 * | 7/2013 | Wagner | F25D 3/06 | 312/229 |
| 11,614,266 | B1 * | 3/2023 | Sutton | A47B 69/00 | 220/592.2 |
| 2006/0055291 | A1 | 3/2006 | Knowles | | |
| 2011/0042910 | A1 * | 2/2011 | Ceballos-Godefroy | A47F 5/108 | 280/42 |
| 2011/0204756 | A1 | 8/2011 | DeMars | | |
| 2014/0306584 | A1 | 10/2014 | DeMars | | |
| 2017/0042325 | A1 | 2/2017 | Tulli et al. | | |
| 2019/0360222 | A1 | 11/2019 | Dunn et al. | | |

* cited by examiner

COLLAPSIBLE BAR ASSEMBLY

CROSS-REFERENCE TO RELATED APPLICATIONS

This application claims the benefit of U.S. Provisional Patent Application Ser. No. 63/470,610, filed on Jun. 2, 2023, which is incorporated by reference herein in its entirety.

FIELD OF THE INVENTION

The present invention relates generally to bar structures, and more particularly, to a full-service bar assembly convertible between a deployed, assembled, service-ready configuration and a collapsed, disassembled, stowed-away configuration.

BACKGROUND OF THE INVENTION

Large events often require the hosting party to provide bartending service. One difficulty in doing so is that the event venue typically does not have a nearby, traditional bar structure that the event guests or attendees can easily access. Even if the event is catered and guests are serviced by the event staff, such as in a hotel, banquet hall or conference center, it is too cumbersome and inconvenient for the catering staff to take drink orders, retrieve the drinks from the distant bar located elsewhere on the property, and return with the drink selections. The lack of a nearby and conveniently accessible bar area is a problematic feature of these venues. One proposed solution is to provide a temporary bar setup. For example, a set of temporary bar stations are placed at various locations around the event premises, making it convenient for guests to access the bar stations. Additionally, in order to provide a higher level of service, the catering staff can efficiently process drink orders at the temporary bar stations. In this way, guests can remain at their tables and be served in a conventional manner. One or two bartenders would typically man each bar station, depending on the expected traffic of guests desiring service.

These temporary bar stations, however, are very minimalistic and do not offer a wide range of selections, especially cocktails. The typical bar station is not a full-service location. It is typically only stocked with a small assortment of beer and wine and a few bottles of alcohol to make mixed drinks and cocktails. The offerings for mixed drinks ordinarily use only the most common, standard base liquors, such as rum, vodka, and gin. A more comprehensive menu, though still limited, might include other distilled spirits such as tequila, whiskey and brandy. There is typically no space to accommodate a wider range of items and other accessories, such as liqueurs, different types of wines, and a variety of beers. For example, the bar station will typically stock just one brand for each selection in the major wine categories, such as red (e.g., Cabernet Sauvignon, Merlot, Shiraz, Pinot Noir, Malbec) and white (Chardonnay, Pinot Grigio, and Sauvignon Blanc). The wine offerings are usually even more limited than this, with just one wine type from each category made available (e.g., one red wine and one white wine). Another limitation of such temporary bar stations is their dedicated, commercial-only use. The temporary bar stations are typically suited to commercial contexts and are not adaptable or readily repurposed to other non-commercial environments and applications, such as domestic spaces (e.g., homes, residences, basement rooms, porches, decks). For example, a common modification to a refinished basement involves the installation of a bar area. However, for a variety of reasons, homeowners typically do not resort to these commercial-ready temporary bar stations and repurpose them for domestic application. Instead, homeowners typically must design a custom bar area, an expensive project.

Food and drink establishments have a bar area that functions as a permanent fixture on the property. The conventional bar area includes a bar top where drinks and food are served. The bar top is typically designed to accommodate patrons who remain at the front bar area either standing or sitting on stools or high-backed chairs to consume their order. The order can be any combination of food and/or beverage. The bar top includes a main, elongate piece of material, such as wood. The bar top is connected to the floor with a bar wall, which is a vertical piece that supports the bar top and runs the length of the bar top. The bar wall separates the front bar from the rear bar, where the bartender is posted. The front edge of the bar top typically includes a bar rail to prevent glasses and other articles (e.g., plates, silverware, bottles) from falling off the bar top. The bar rail is typically constructed as a raised molding that extends the length of the bar. A lower foot rail is placed at the front bar area to increase the sitting comfort of the patron, since the bar top is usually at an elevation higher than a customary table, which means that a patron sitting on the bar stool will not have their feet resting on the ground. At the rear bar area, a glass rail attached to the bar top is used to hold glasses while the bartender prepares the mixed drinks. It is manifestly clear that a bar structure of the type used in restaurants and drinking establishments cannot be readily replicated at unconventional or non-traditional locations where drink and beverage service is needed. Nevertheless, demand remains for the type of full-service bartending experience that a traditional bar offers at locations where no such conventional bar structures exist, nor would it be practical or feasible to install one.

It has become increasingly common for certain venues to host organized events requiring a staffed beverage service, such as a bartender manning a bar station and servicing customers, patrons and other clients. These venues do not ordinarily offer easy and convenient access to bartending services. Additionally, the clients who requisition these venues expect the host facility to provide a full-service beverage experience, not a scaled-down version offering limited drink options and selections. In effect, the clients expect a traditional bartending service in very non-traditional locations. For example, bartenders are often contracted to provide service in locations such as homes, domestic residences, outdoor areas, conference venues, festivals, country clubs, and private function halls. As just one example, an increasing trend among couples preparing for marriage is to host the wedding reception outdoors. These venues include places such as mansion estates, lakeside properties, parks, and residential areas with sprawling estates able to accommodate a reception. In terms of indoor venues, churches typically will rent out their meeting balls and gymnasium facilities for use as a wedding reception area.

However, in all of these situations mentioned above, there is no existing onsite bartending facility. Anyone hired to provide beverage service at the event would need some type of temporary bartending structure that can be easily set up prior to the event and quickly broken down following the conclusion of the event. Some events will require more than one bartending station. For example, some outdoor venues host events in which the attendees, guests or participants are widely dispersed about the property or facility, requiring several bartending stations posted at various strategic locations easily accessible to the visitors. The bartending station should also have the intuitive, familiar, look-and-feel of a bartending layout so that any suitable staff member can work at the station and easily navigate its features to provide beverage service. The bartending structure should also meet the demands and requirements of the event, which increasingly involve a full-service beverage offering that is similar if not substantially identical to what is available in a brick-and-mortar establishment (e.g., a restaurant, lounge, or public bar).

Accordingly, there is a need for a solution to at least one of the aforementioned problems. For instance, there is an established need for a portable and collapsible bar assembly that features a quick and convenient setup and dismantling, and which offers a full-service beverage experience. Moreover, there is a need for a modular bar design capable of use in a wide variety of environments, including commercial, private, and residential applications.

SUMMARY OF THE INVENTION

The present invention is directed to a bar assembly having a rear bar area manned by a bartender and a front bar area where customers or patrons address the bartender for service. The bar assembly includes a pair of leg structures each sized, shaped and dimensioned to form an open-sided rectangular prism. The bar assembly further comprises a counter subassembly including, in combination, a foldable counter top and a foldable, raised shelf disposed in an elevated relationship to the counter top. The pair of leg structures are deployed in a spaced-apart relationship and support the foldable counter top at respective ends thereof to form a table-like arrangement. The pair of leg structures are further deployed in an upright orientation so that the top, horizontally oriented side of the leg structure bears the counter top, and the bottom side rests on the ground surface. The deployed leg structures are further oriented so that their open side faces inwards towards each other. A set of basin-receiving openings are formed in the body of the counter top. Each basin-receiving opening receives a removable sink-type basin. A faucet is installed for use with one of the basins. A frame includes a front panel subassembly located at the front bar area and a rear panel subassembly located at the rear bar area, each extending between the pair of leg structures. An arrangement of latch mechanisms releasably fastens the panel-based frame to the pair of leg structures. The rear panel subassembly includes an elongated rear panel. The elongated rear panel removably supports a rear speed rail receptacle. The front panel subassembly includes, in combination, a lower panel and an upper panel disposed in a spaced-apart relationship. The upper panel of the front panel subassembly includes, in combination, a top portion extending above the plane of the counter, and an adjoining bottom portion extending below the plane of the counter. The top portion of the upper panel of the front panel subassembly includes, in combination, a central panel section and a pair of pivotable, shelf-supporting, end panel sections each hingedly attached to the central panel section at opposite ends thereof. The central panel section includes an opening or window enabling direct line-of-sight between the bartender and customer. During assembly, the pivotable, shelf-supporting, end panel sections are pivoted into position relative to the central panel section to support the raised shelf. The bar assembly can be reconfigured in a disassembled form and stowed as a set of discrete pieces in a case defined by the pair of leg structures. In particular, once the bar assembly is dismantled, the leg structures respectively define joinable and complementary half sections that cooperate together to form the case. The enclosure space of the case is able to stow and carry, as discrete items, the folded counter top, the folded shelf, the rear panel subassembly, the front panel subassembly, the rear speed rail receptacle, and the set of sink-type basins. For purposes of transporting the case, one of the leg structures is adapted to include a set of wheels and a handle to render the case mobile and portable. The bar assembly can be easily assembled and disassembled. The assembling operation uses simple mechanical devices, such as latches, to easily fasten the pieces together and to permit quick and efficient release during disassembly. The portability of the bar assembly features an optimization of parts. In particular, the leg structures are integral, dual-purpose pieces, used both in the deployment configuration and the stowed configuration of the bar assembly. More specifically, the pair of leg structures, which serve as column-type pieces during deployment to support the counter subassembly and to provide the means to secure the frame at the front and rear bar areas, also function as the half section components together forming the case that carries the rest of the bar assembly pieces. The deployed bar assembly further includes a self-contained and self-sustaining water supply subassembly to provide water to the faucet at one of the basins. The water supply subassembly includes, in combination, a water receptacle and a pump system configured to pump water from the water receptacle to the faucet. In one form, the pump system includes a foot-powered, manually driven pump. An inlet hose connects the water receptacle to the pump and an outlet hose connects the pump to the faucet. During use, a volume of free-standing water is deposited in the water receptacle. As the need arises, the user or bartender actuates the foot pump, which controllably communicates a flow of water to the faucet based on the pump actuation level. The bar assembly does not require any hook-up or installation to the water lines of the onsite premises or resident facility. The user simply loads water into the water receptacle from the local, on-site water supply and places the filled water receptacle at the bar assembly. If the water is exhausted and more is needed, the bartender can repeat the same loading process. In this way, the bartender need not worry about making any secure, seal-tight, water-tight connections to the on-site water supply infrastructure. The bar assembly can be optionally equipped with various accessories. For example, the foldable, raised shelf can removably support a set of liquid dispensers.

In a first implementation of the invention, a bar assembly comprises:

- a front bar area and a rear bar area;
- a pair of support legs;
- a foldable counter removably disposed on the pair of support legs;
- a frame including a front portion disposed at the front bar area and a rear portion disposed at the rear bar area, the front portion, and the rear portion of the frame each removably extending at least in part between the pair of support legs;
- a foldable elevated shelf disposed over the counter and supported by the front portion of the frame; and
- a rear speed rail receptacle disposed at the rear bar area and removably supported by the rear portion of the frame;

wherein the bar assembly is operable to adopt a disassembled and stowed configuration in which the pair of support legs define respective joinable half sections cooperatively forming a selectively openable and closable case defining an enclosure space, and in which the case carries as discrete items in the enclosure space at least one of the folded counter, the folded shelf, the frame, and the rear speed rail receptacle.

In a second aspect, the front bar area defines a location accessible by a customer seeking bartending service, and the rear bar area defines a location manned by a bartender offering the bartending service.

In another aspect, the front portion of the frame defines a front panel subassembly, and the rear portion of the frame defines a rear panel subassembly.

In another aspect, the rear portion of the frame includes a panel.

In another aspect, the front panel subassembly includes a lower panel and an upper panel. The upper panel of the front panel subassembly includes a top section extending at least in part above the counter and an adjoining bottom section extending at least in part below the counter. The top section includes, in combination, a central panel having an opening, and a pair of pivotable wing panels hingedly joined to the central panel at respective ends thereof.

In another aspect, the pair of pivotable wing panels of the top section of the upper panel of the front panel subassembly support the foldable elevated shelf.

In another aspect, each support leg includes, in combination, an opposing top side and a bottom side; an opposing front side and a rear side each extending between the top side and the bottom side; an outer side extending between the top side and the bottom side and further extending between the front side and the rear side; and, an inner-side opening disposed opposite and facing the outer side. In one form, each support leg defines an open-sided rectangular parallelepiped. In another form, each support leg defines an open-sided box configuration and/or a rectangular prism. The dimension extending between the top side and the bottom side of each support leg defines a height of the support leg.

In another form, each support leg defines an open-sided, rectangular-shaped enclosure.

In another aspect, during deployment of the bar assembly, the support legs are disposed in an upright, standing, spaced-apart relationship to one another with the inner-side openings thereof facing one another, and the bottom sides thereof defining the ground level resting support surface.

In another aspect, during deployment of the bar assembly, the foldable counter is supported at opposite ends by the pair of support legs at the top sides thereof.

In another aspect, one of the support legs includes a wheel arrangement.

In another aspect, one of the support legs includes a handle.

In another aspect, the foldable counter includes a periphery having a front edge, a rear edge, and a pair of side edges extending between the front edge and the rear edge. In one form, the foldable counter includes a fold line extending between the front edge and the rear edge of the periphery thereof to define half sections of the foldable counter that are pivotable relative to one another.

In another aspect, the pair of side edges of the foldable counter each transitions to the rear edge using a beveled corner.

In another aspect, the foldable counter includes at least one basin-receiving opening formed in the foldable counter.

In another aspect, the at least one basin-receiving opening formed in the foldable counter includes a middle opening and a pair of end openings formed on opposite sides of the middle opening.

In another aspect, the fold line of the foldable counter bisects the middle opening of the at least one basin-receiving opening formed in the foldable counter.

In another aspect, the bar assembly includes at least one basin each removably received by a respective one of the at least one basin-receiving opening formed in the foldable counter.

In another aspect, at least one basin defines a sink.

In another aspect, each basin is configured to seat in its respective basin-receiving opening formed in the foldable counter such that a receptacle space defined by the basin is located substantially below the foldable counter.

In another aspect, the foldable elevated shelf includes a periphery having a front edge, a rear edge, and a pair of side edges extending between the front edge and the rear edge. In one form, the foldable elevated shelf includes a fold line extending between the front edge and the rear edge of the periphery thereof to define half sections of the foldable elevated shelf that are pivotable relative to one another.

In another aspect, the pair of side edges of the foldable elevated shelf each transitions to the front edge using a beveled corner.

In another aspect, during deployment of the bar assembly, the fold line of the foldable counter and the fold line of the foldable elevated shelf both lie in a common vertical plane.

In another aspect, the bar assembly includes a hook arrangement configured to releasably support the rear speed rail receptacle on the rear panel subassembly.

In another aspect, the bar assembly includes a latch arrangement configured to releasably fasten the front panel subassembly to the pair of support legs.

In another aspect, the bar assembly includes a set of liquid dispensers supported by the foldable elevated shelf.

In another aspect, the bar assembly includes a faucet associated with one of the installed basins and a water supply subassembly configured to supply water to the faucet.

In another aspect, the water supply subassembly includes a water-holding receptacle and a pump system configured to communicate water from the water-holding receptacle to the faucet.

In another aspect, the pump system of the water supply subassembly includes a foot-powered pump, an inlet hose defining a water communication path from the water-holding receptacle to the foot-powered pump, and an outlet hose defining a water communication path from the foot-powered pump to the faucet.

In another aspect, the water-holding receptacle of the water supply subassembly includes a cylindrical container and a valve assembly configured to control and/or regulate fluid flow from the cylindrical container to the inlet hose of the pump system of the water supply subassembly.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which:

FIG. 1*l* is a perspective view of an alternative water supply system for use with the bar assembly shown in FIGS. 1-10.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a bar assembly convertible and/or transitionable between a deployed, assembled, service-ready configuration and a collapsed, disassembled, stowed-away configuration. In its collapsed condition, the bar assembly is portable and supports a variety of operations and functions, including stowage, storage, and transportation between venues or locations. The bar assembly has a wheeled arrangement available for use in the collapsed condition, which makes it easy to transport the collapsed bar assembly as a roller-type mobile unit and avoids any need to lift and carry the collapsed bar assembly. The bar assembly features a modular arrangement that facilitates a quick setup and re-assembly from its collapsed, packed-away condition.

Figure 1:
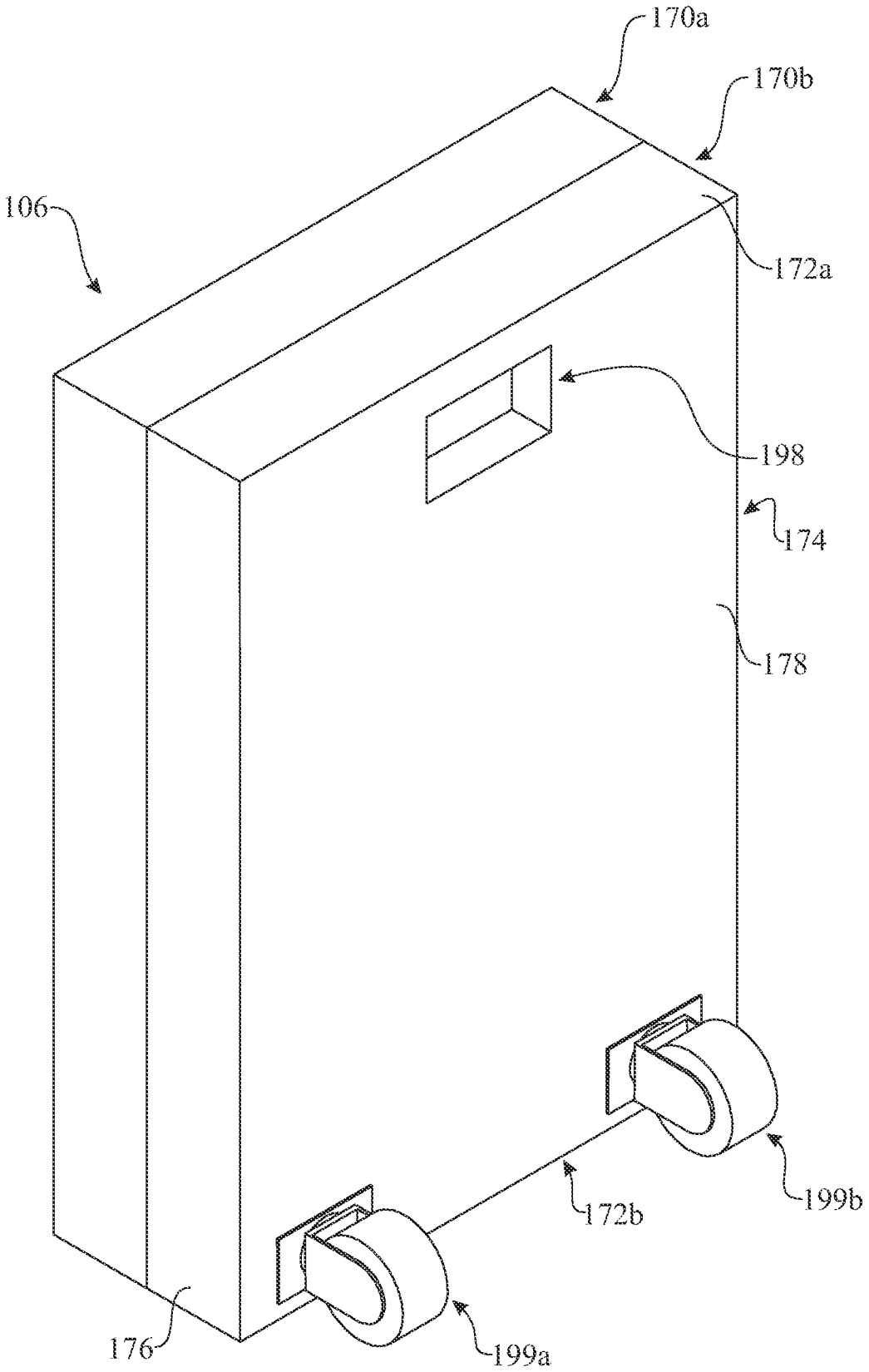
FIG. 1 presents an upper, side perspective view of a bar assembly in its collapsed and disassembled configuration packed away in a portable case, in accordance with a first illustrative embodiment of the present invention.
Figure 6:
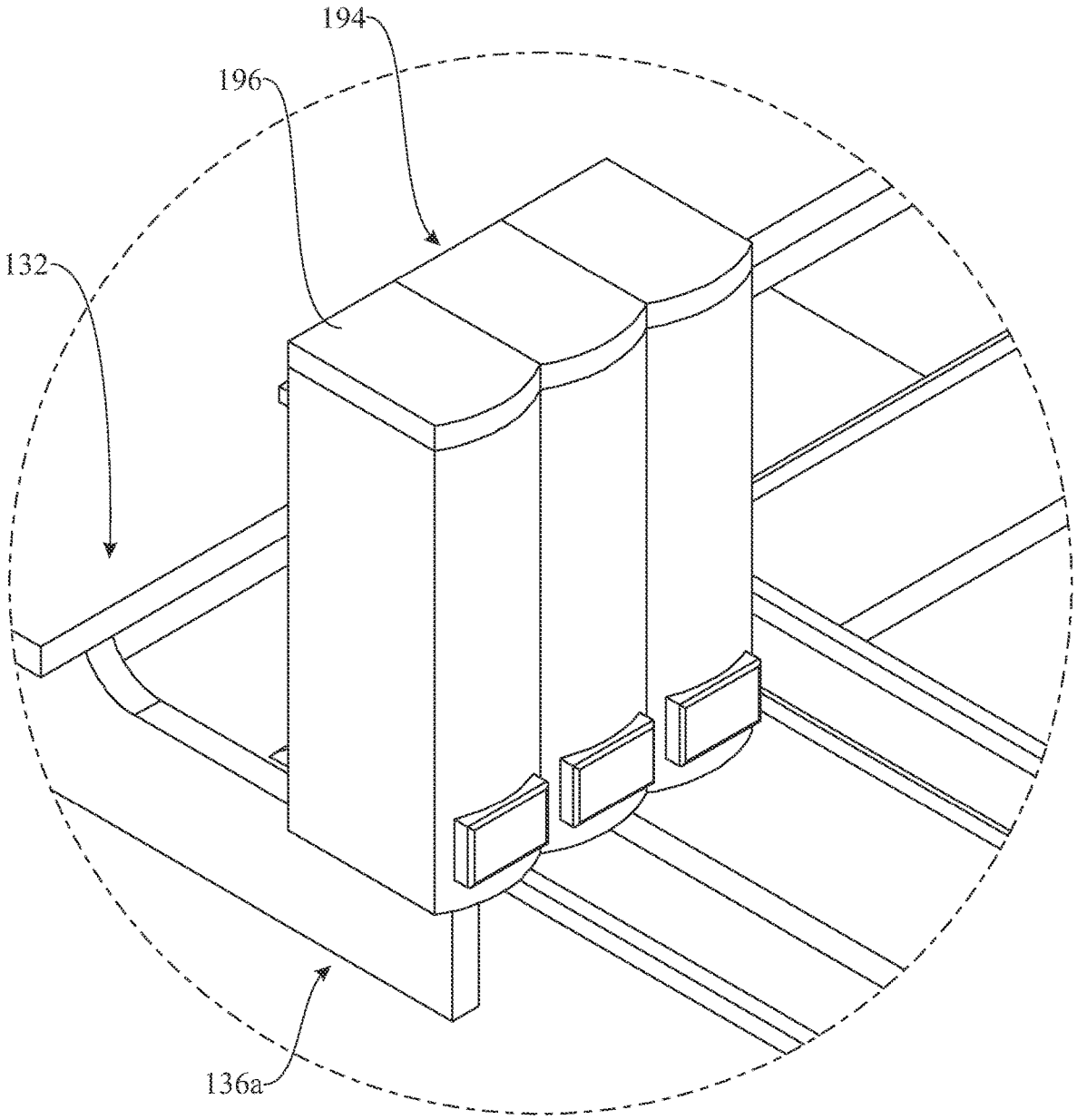
FIG. 6 presents an exploded, upper, sectional perspective view of a set of dispensers installed with the elevated counter-top shelf illustrated in FIG. 2.
Figure 7:
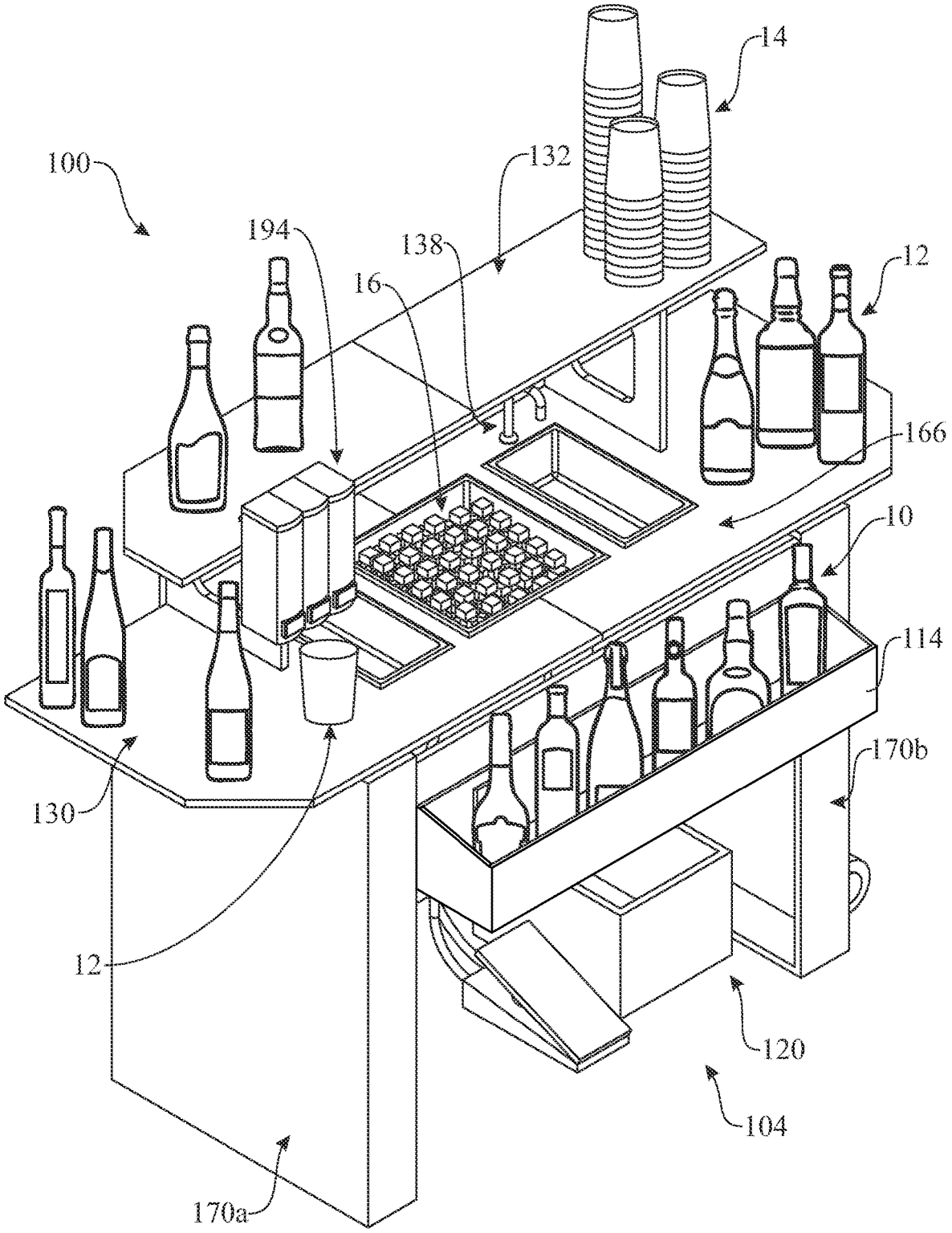
FIG. 7 presents an upper, left-side, rear perspective view of the deployed bar assembly illustrated in FIG. 2, more particularly illustrating how the bar assembly is stocked with a variety of items conducive to providing bar service.

Referring initially to FIGS. 1-10, a bar assembly 100 is illustrated in accordance with a first exemplary embodiment of the present invention. In different operational configurations, the bar assembly 100 is collapsible, stowable, and re-deployable. FIGS. 2-3, 7 and 9 show the bar assembly 100 in its fully assembled, service-ready, work-available, deployment configuration. FIG. 7, in particular, shows the fully deployed bar assembly 100 stocked with an inventory of merchandise (e.g., beverages), materials, and supplies available for offering a full-service bartending experience. FIGS. 4-6 and 8 depict various fragmentary and sectional views highlighting certain components of the deployed bar assembly 100. FIG. 1 shows bar assembly 100 in a stowage configuration following a disassembly process, in which the dismantled bar assembly 100 is reconfigured for storage, carriage, and transport. FIGS. 10A-H depict an illustrative sequence of operations for re-assembling the bar assembly 100 from various components and pieces supplied by the stowage configuration of FIG. 1. FIGS. 10A-H, in particular, illustrate the transition of bar assembly 100 from its stowed, disassembled configuration shown in FIG. 1 to its deployed, fully assembled configuration shown in FIG. 2

Figure 9:
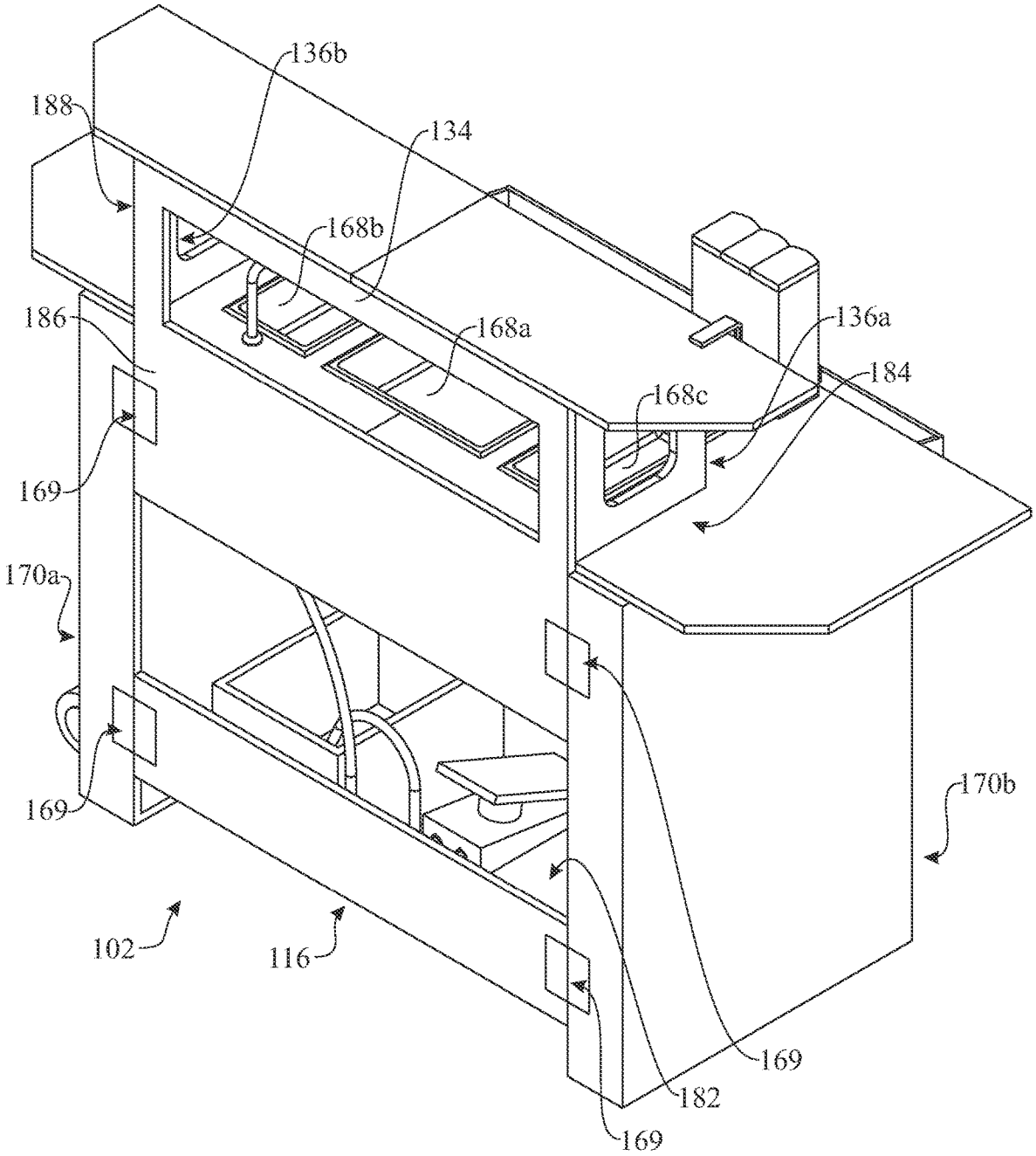
FIG. 9 presents an upper, front perspective view of the deployed bar assembly illustrated in FIG. 2, more particularly illustrating the front bar area or customer service side of the deployed bar assembly.
Figure 10A:
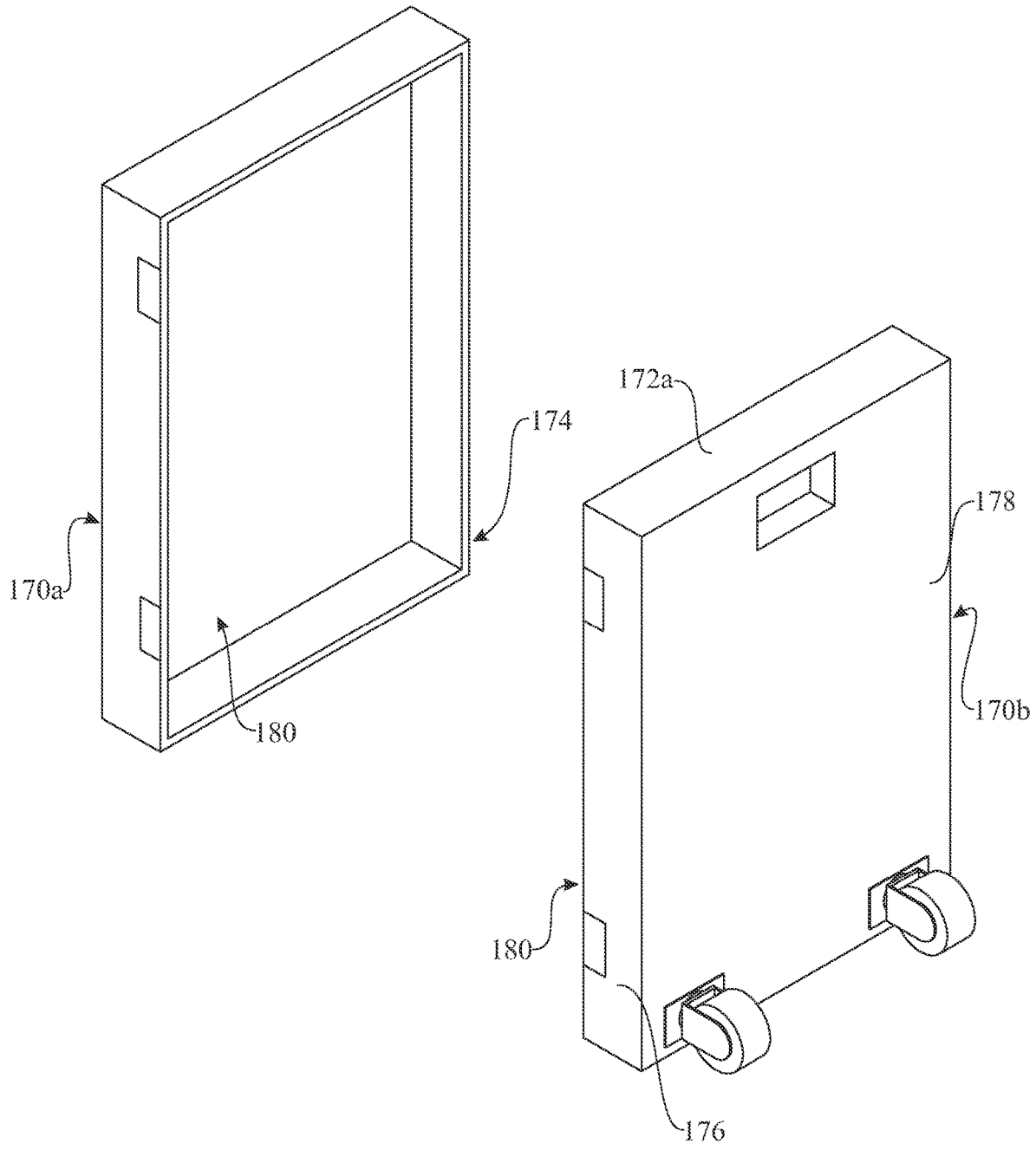
FIGS. 10A-H present a series of perspective views illustrating one exemplary sequence of operations for assembling the bar assembly shown variously in FIGS. 1-8, more particularly illustrating the transition of the bar assembly from its stowed, disassembled configuration shown in FIG. 1 to its deployed, fully assembled configuration shown in FIG. 2.
Figure 10B:
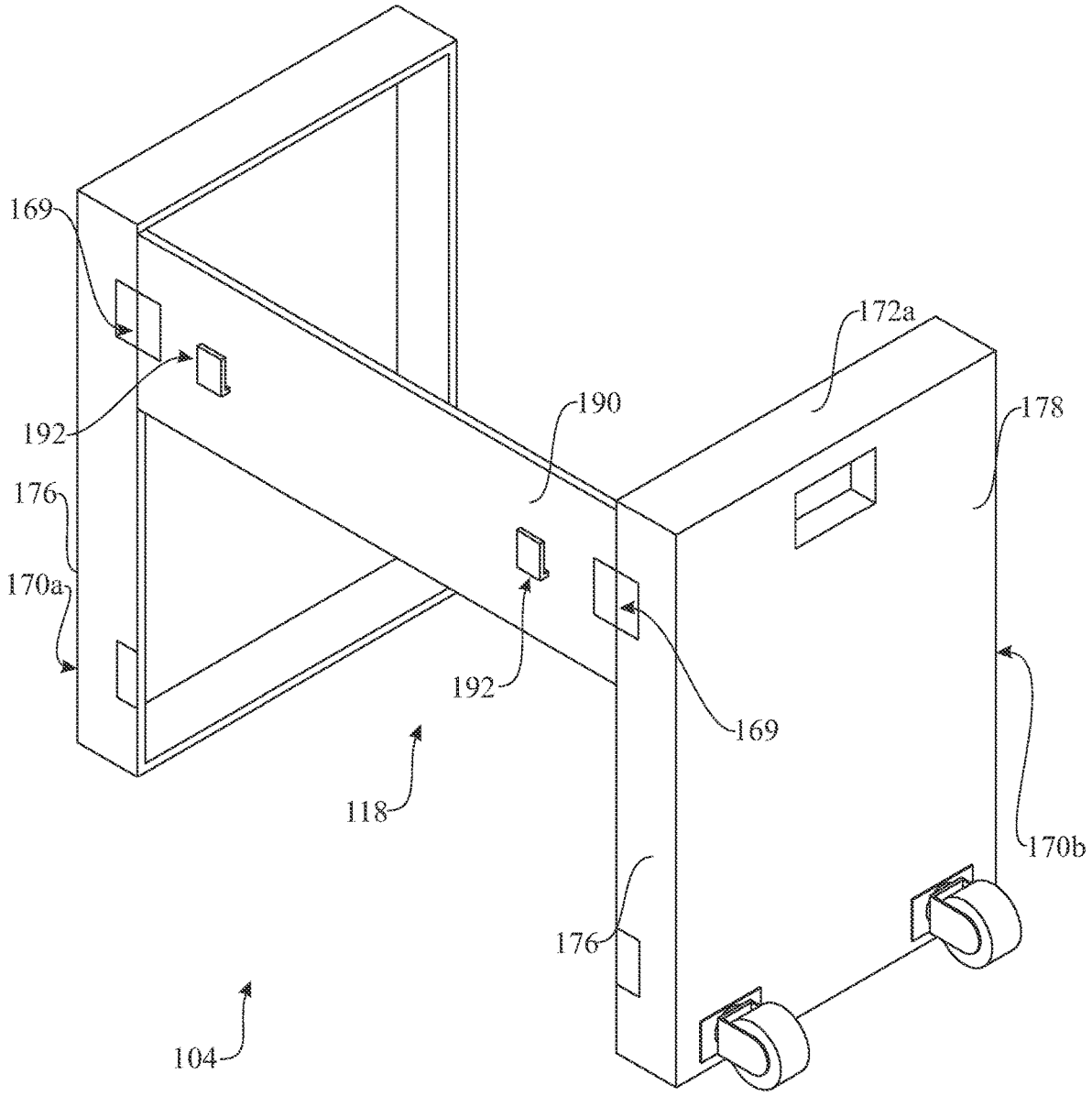
Figure 10C:
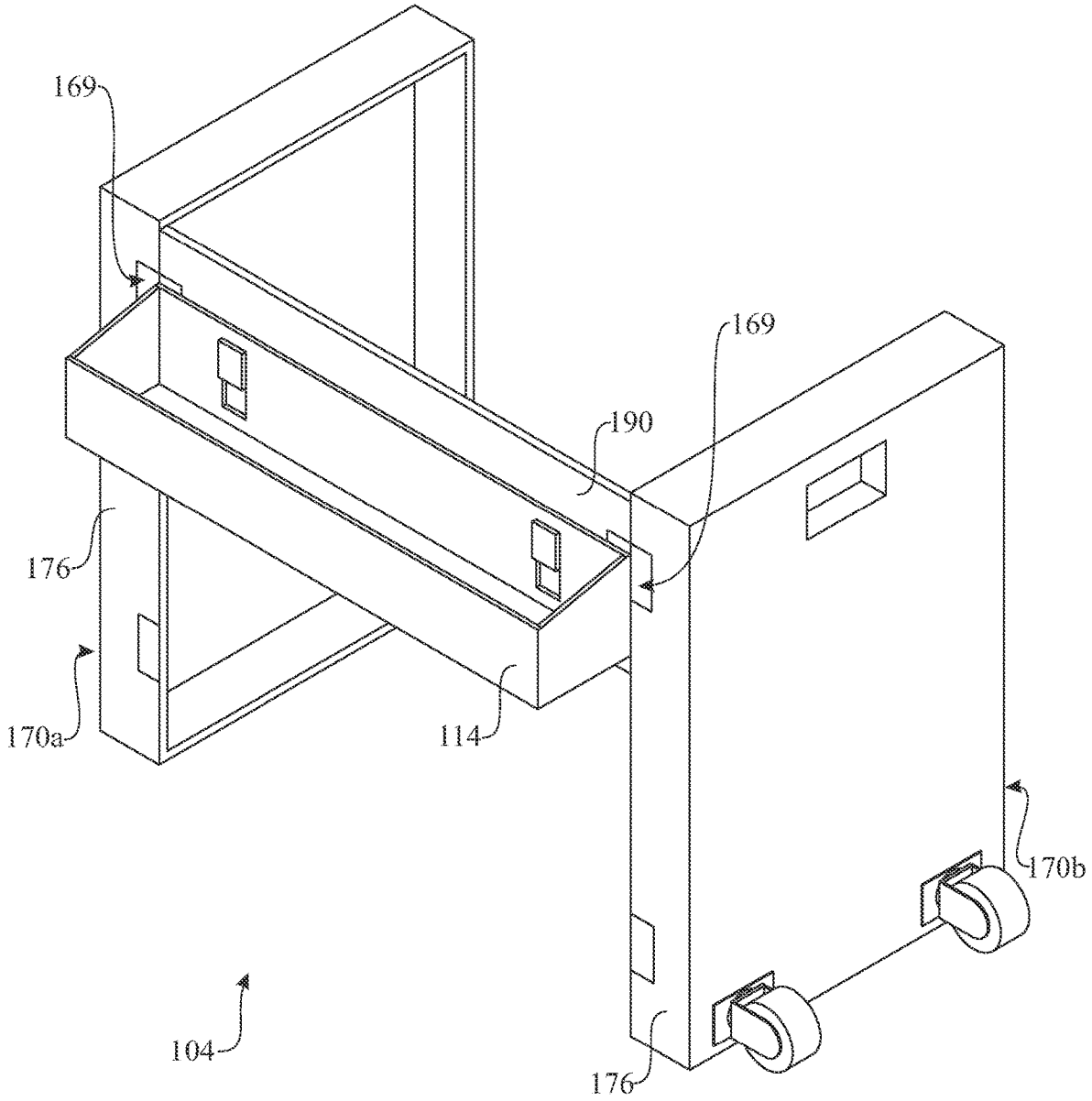
Figure 10D:
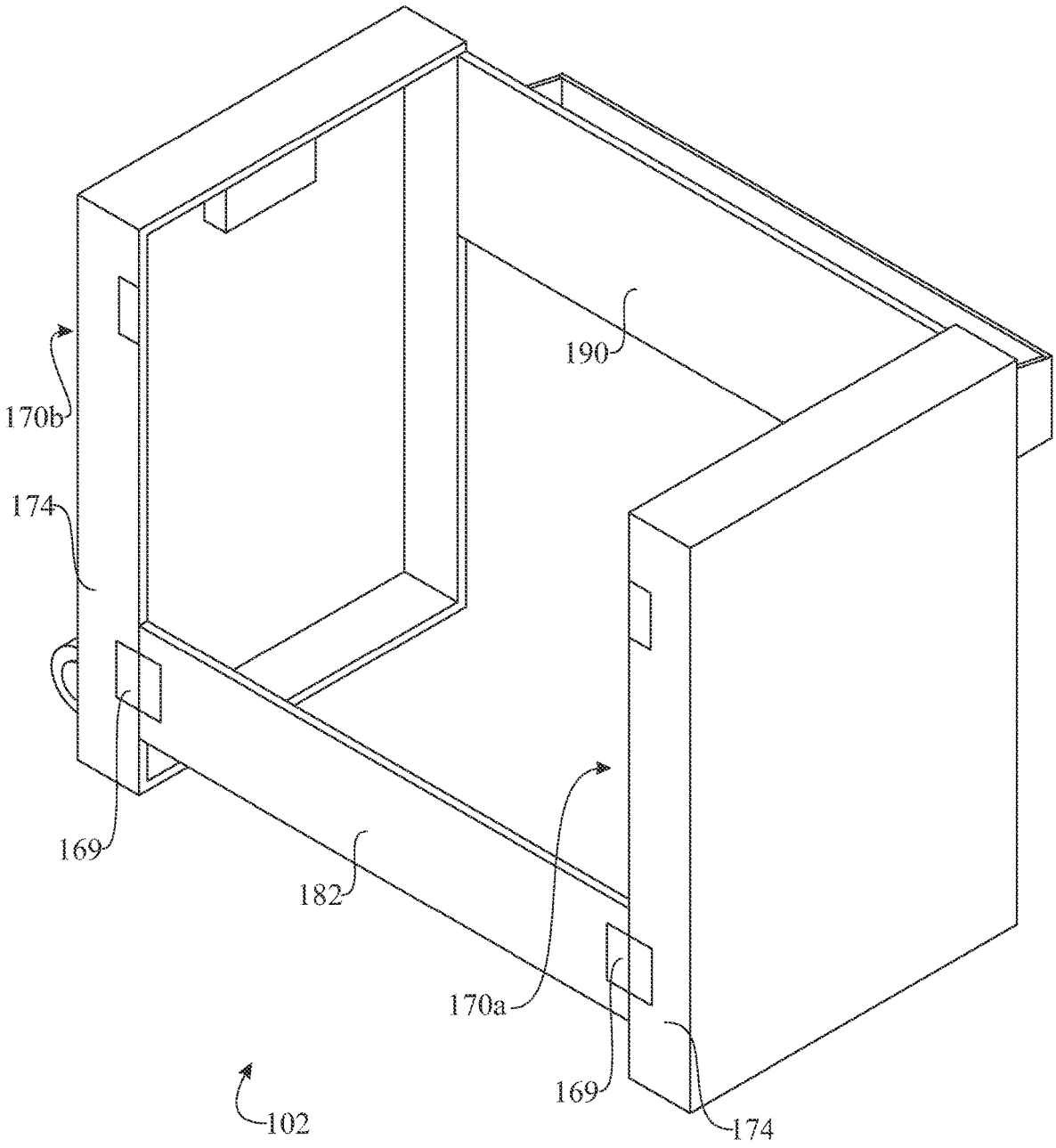
Figure 10E:
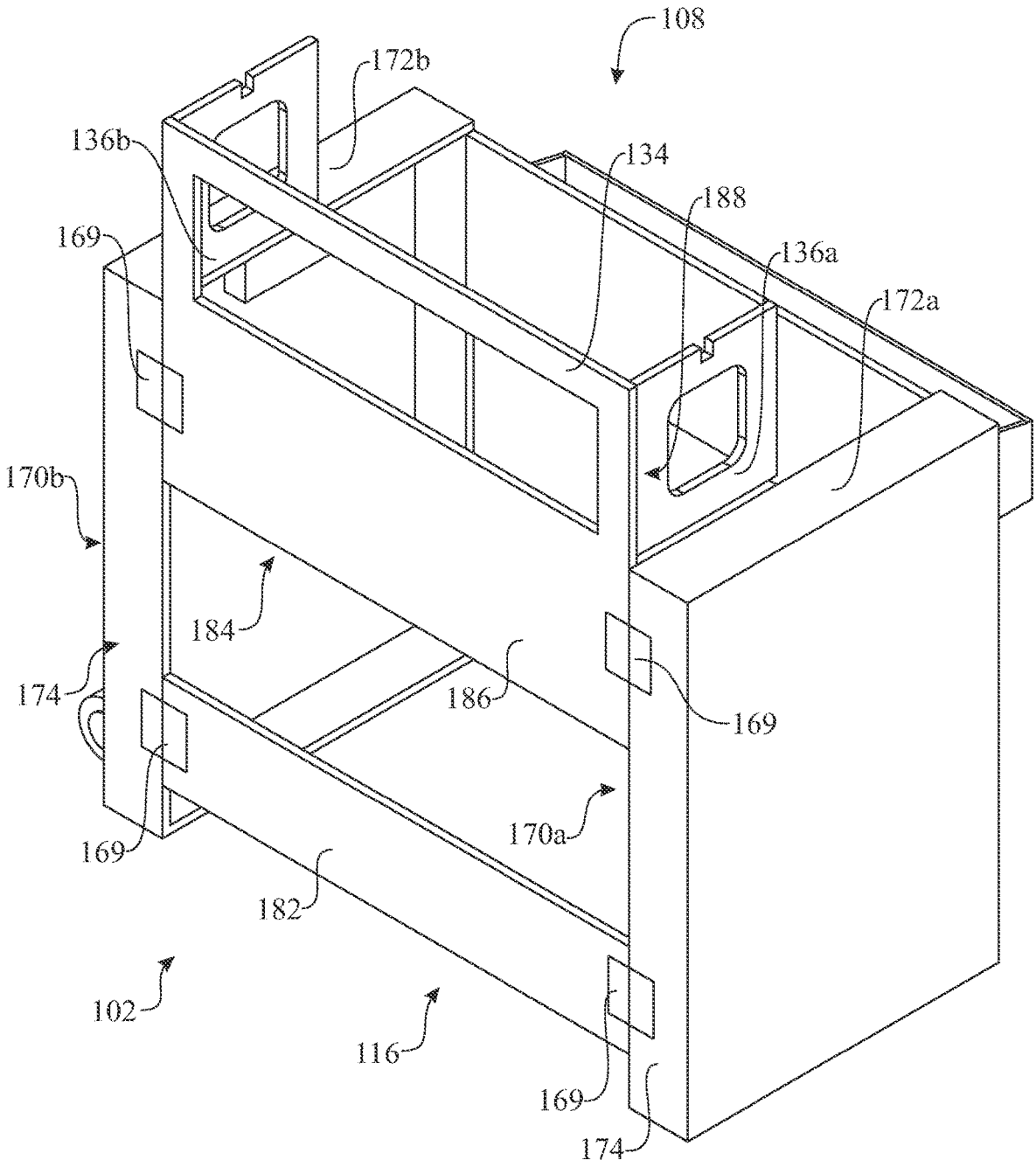

Referring more particularly to FIGS. 2-3, 9 and 10A-H, the bar assembly 100 includes, in combination, a counter subassembly 110 having a foldable counter top 130 and a foldable raised shelf 132 disposed above counter 130; a counter-supporting subassembly 112 configured to support the counter subassembly 110 at counter 130; a rear speed rail receptacle 114; a front panel subassembly 116 configured in part to support the counter subassembly 110 (raised shelf 132); a rear panel subassembly 118 configured to support the rear speed rail receptacle 114; and, a water supply subassembly 120. The combination of front panel subassembly 116 and rear panel subassembly 118 forms a frame 108 releasably attached to the counter-supporting subassembly 112 (FIG. 10E). The bar assembly 100 defines a front bar area generally illustrated at 102 that provides customer access, and a rear bar area generally illustrated at 104 that is manned or staffed by a bartender to provide beverage service to a customer interfacing with bar assembly 100 at front bar area 102. The front bar area 102 and rear bar area 104 are located on opposite sides of bar assembly 100. The front panel subassembly 116 defines a front portion of frame 108 disposed at the front bar area 102, and the rear panel subassembly 118 defines a rear portion of frame 108 disposed at the rear bar area 104.

The counter-supporting subassembly 112 includes, in combination, a pair of support legs generally illustrated at 170*a,b*. The support legs 170*a,b* are identically constructed, so a reference to one applies equally to the other. Each support leg 170*a,b* is sized, shaped and dimensioned to form an open-sided rectangular prism or open box-type configuration defining an enclosure space. Referring briefly to FIG. 1, each support leg 170*a,b* defines a respective half section component that is joinable to the other half section component to form a luggage-ready, selectively openable and closable, container-style case 106 defining an interior enclosure space. The support legs 170*a,b* are joinable to form case 106 by facing their open-sided ends towards one another to create the interior enclosure space of case 106.

Figure 2:
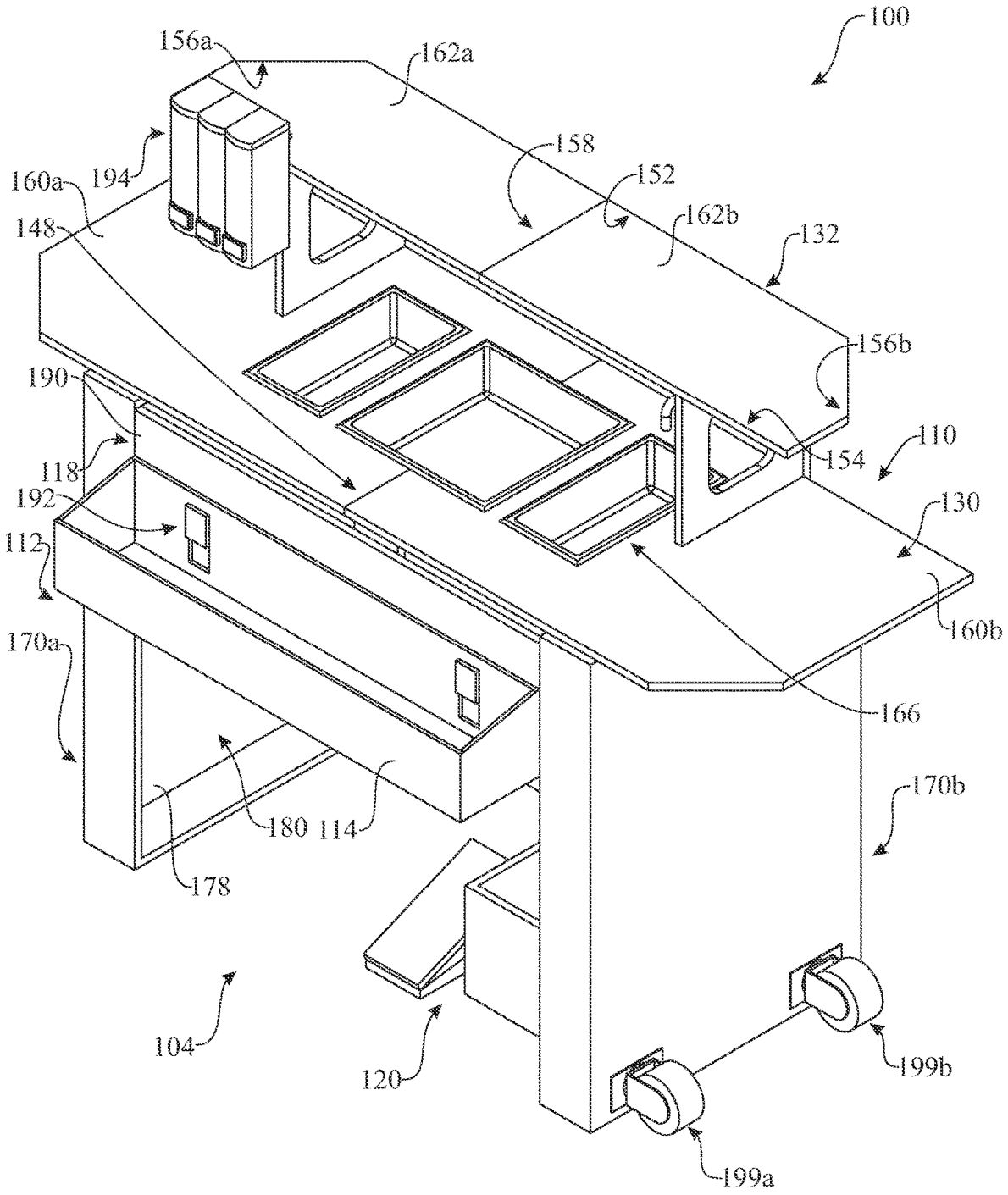
FIG. 2 presents an upper, right-side, rear perspective view of the bar assembly stowed away in FIG. 1 and now deployed in an unpacked and fully re-assembled configuration, more particularly illustrating the rear bar area or working side of the deployed bar assembly manned by a bartender.
Figure 3:
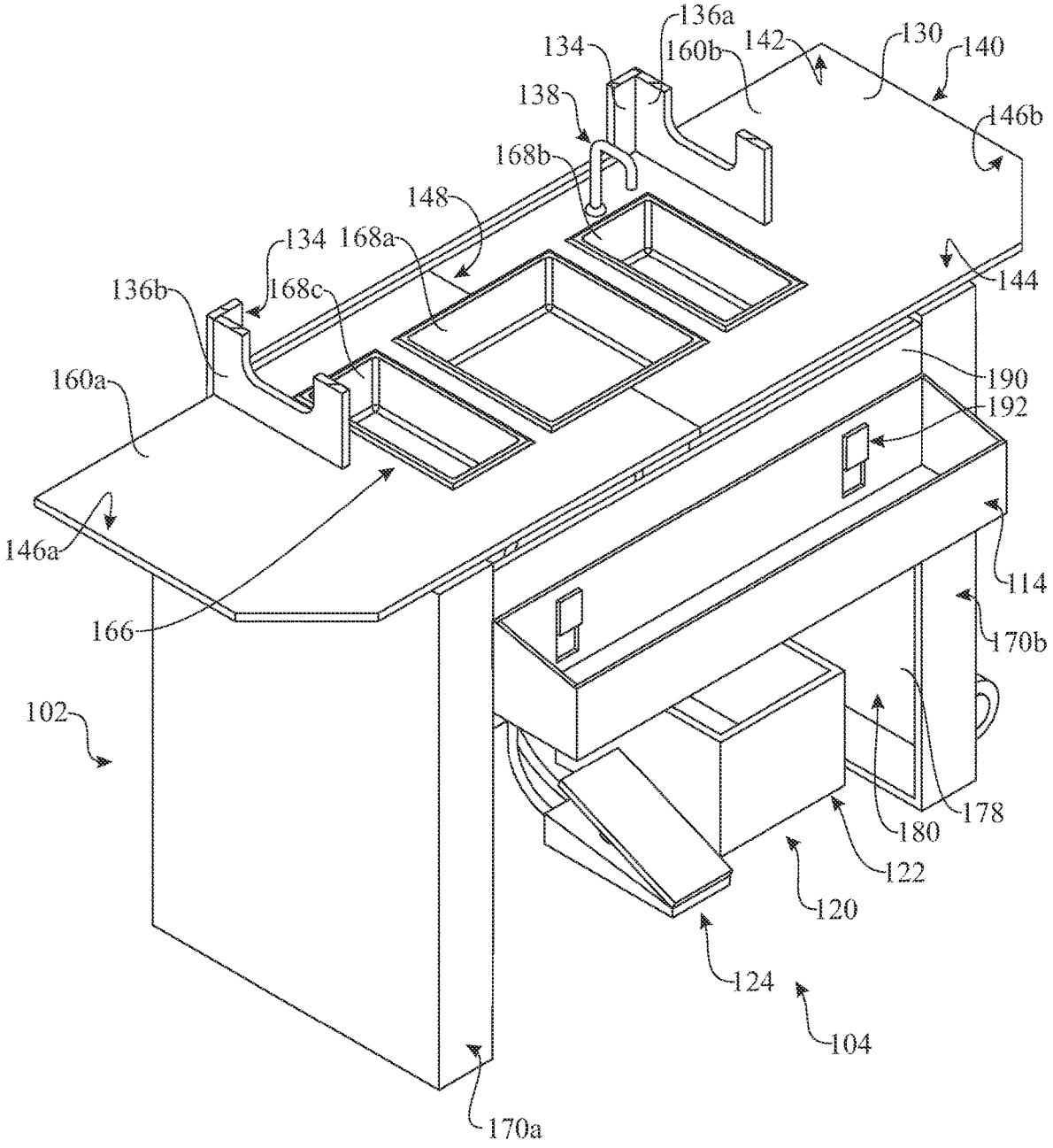
FIG. 3 presents an upper, left-side, rear perspective view of the deployed bar assembly illustrated in FIG. 2, in which the raised counter-top shelf has been removed and the shelf-supporting panels depicted in fragmentary view in order to more clearly illustrate the set of recessed basins sunk into the counter.
Figure 4:
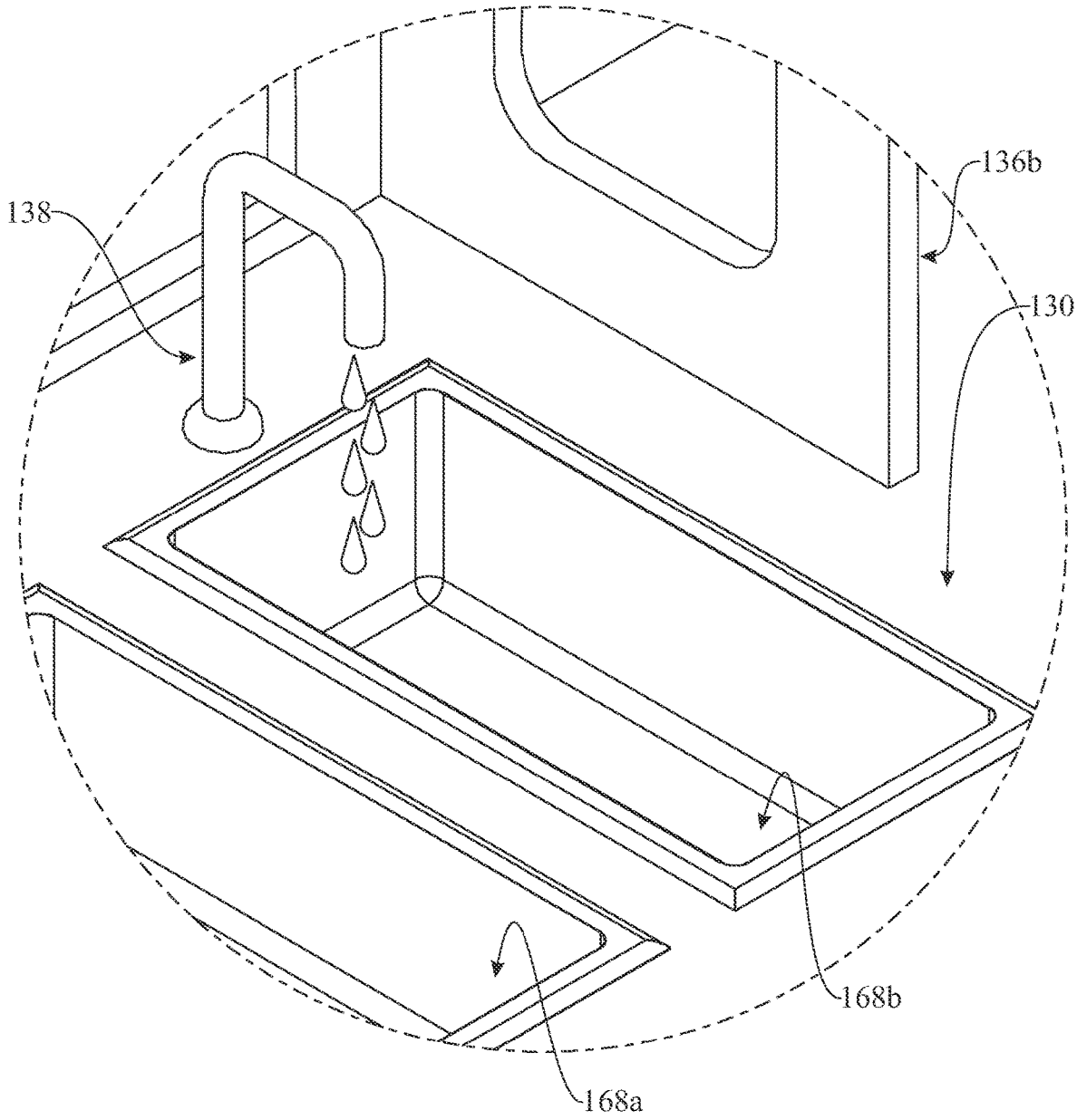
FIG. 4 presents an exploded, upper, sectional perspective view of a faucet installed for use with one of the counter-top basins shown in FIG. 3.
Figure 5:
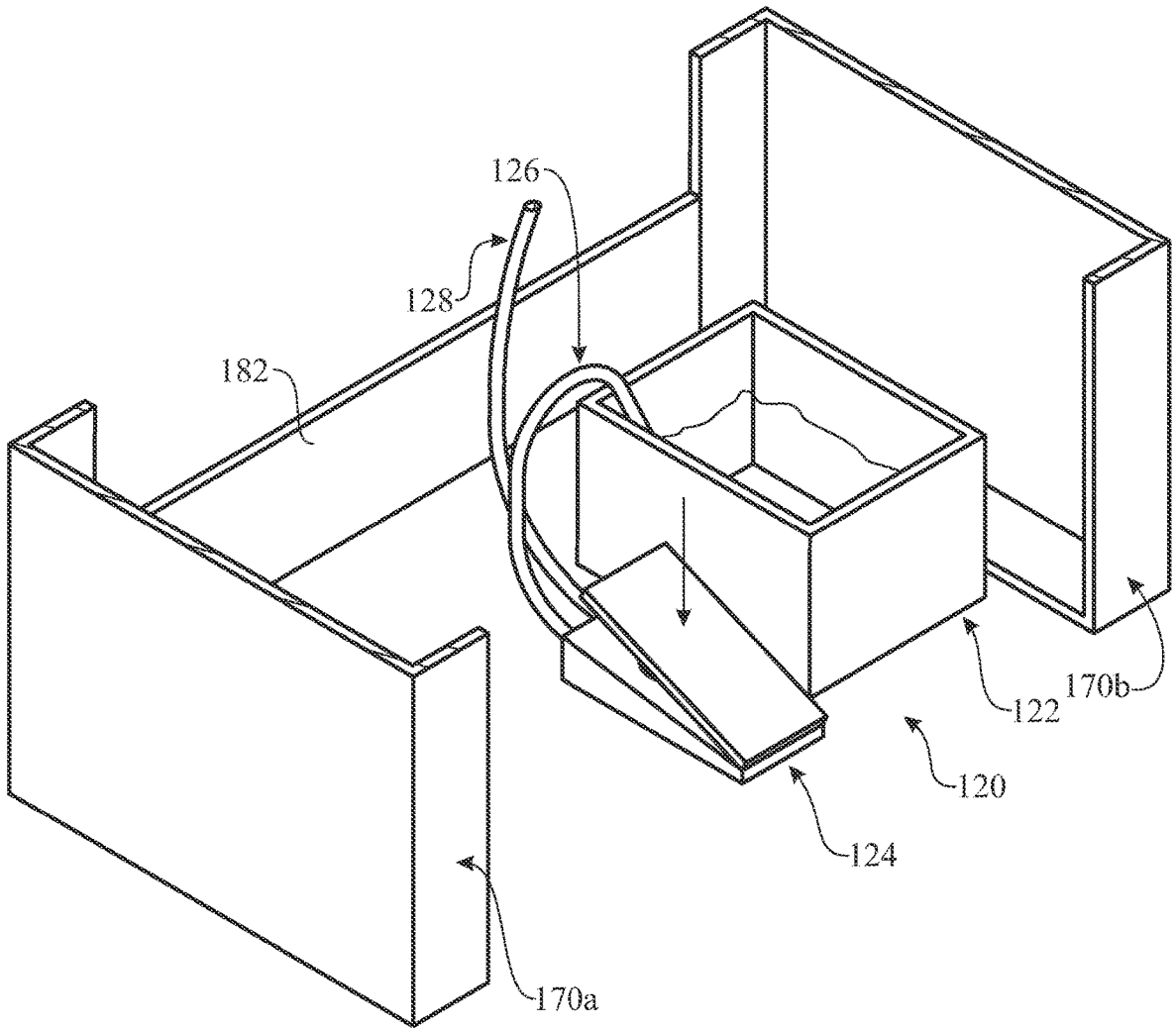
FIG. 5 presents an upper, left-side, rear perspective view of the deployed bar assembly illustrated in FIG. 3, in which the counter-top has been removed to more clearly illustrate the foot-powered, manually-driven, water pump system furnishing water to the faucet shown in FIG. 4.

Referring still to FIG. 1, each support leg 170*a,b* includes top side 172*a* and a bottom side 172*b* disposed opposite one another; a front side 174 and a rear side 176 disposed opposite one another in a spaced-apart relationship and extending between the top side 172*a* and bottom side 172*b*; and, an outer side 178 extending in a height direction between the top side 172*a* and bottom side 172*b* and extending in a lateral direction between the front side 174 and rear side 176. The front side 174 faces the front bar area 102, while the rear side 176 faces the rear bar area 104. All of the sides of support legs 170*a,b* have a generally planar, solid construction. Each support leg 170*a,b* is open-sided at the end opposite the outer side 178, forming an inner-side opening 180 that communicates with the interior space of support legs 170*a,b* (FIGS. 2-3 and 10A). During assembly, as shown in FIG. 10A, the support legs 170*a,b* are disposed in a suitable spaced-apart relationship with the respective inner-side openings 180 facing one another. The deployed support legs 170*a,b* are further disposed in a standing, erect, upright orientation so that the bottom side 172*b* rests on the ground surface, and the top side 172*a* is available to support overlying articles. In this deployed arrangement of support legs 170*a,b*, the top side 172*a* and bottom side 172*b* are oriented horizontally, while the front side 174, rear side 176, and outer side 178 are oriented vertically.

Referring specifically to FIG. 3, the foldable counter top 130 of counter subassembly 110 defines a main or primary working surface of bar assembly 100. During deployment, the counter 130 is disposed on the pair of support legs 170*a,b* in a supporting, resting relationship. In particular, the counter 130 is supported at opposite ends by the pair of support legs 170*a,b* and rests directly on the top side 172*a* of support legs 170*a,b*, as shown in the transition from FIG. 10E (counter 130 not installed) to 10F (counter 130 installed). The combination of support legs 170*a,b* and overlying counter 130 forms a table-like arrangement. The body of counter 130 has a generally planar construction. The counter 130 includes an edge periphery 140 having a front edge 142 proximal the front bar area 102, a rear edge 144 proximal the rear bar area 104, and a pair of side edges 146*a,b* extending between the front edge 142 and rear edge 144. In one form, the pair of side edges 146*a,b* transition to rear edge 144 using a beveled corner, producing a chamfered profile for side edges 146*a,b*. The counter 130 further includes a fold line 148 extending between the front edge 142 and rear edge 144 of periphery 140. The fold line 148 is configured to enable counter 130 to fold into two equal or identical half sections 160*a,b* that lie on one another as a compact unit, making it easy, convenient and space-efficient to store and transport the folded counter 130. The central fold line 148 is preferably a midline dividing counter 130 into two substantially equal parts.

Figure 10F:
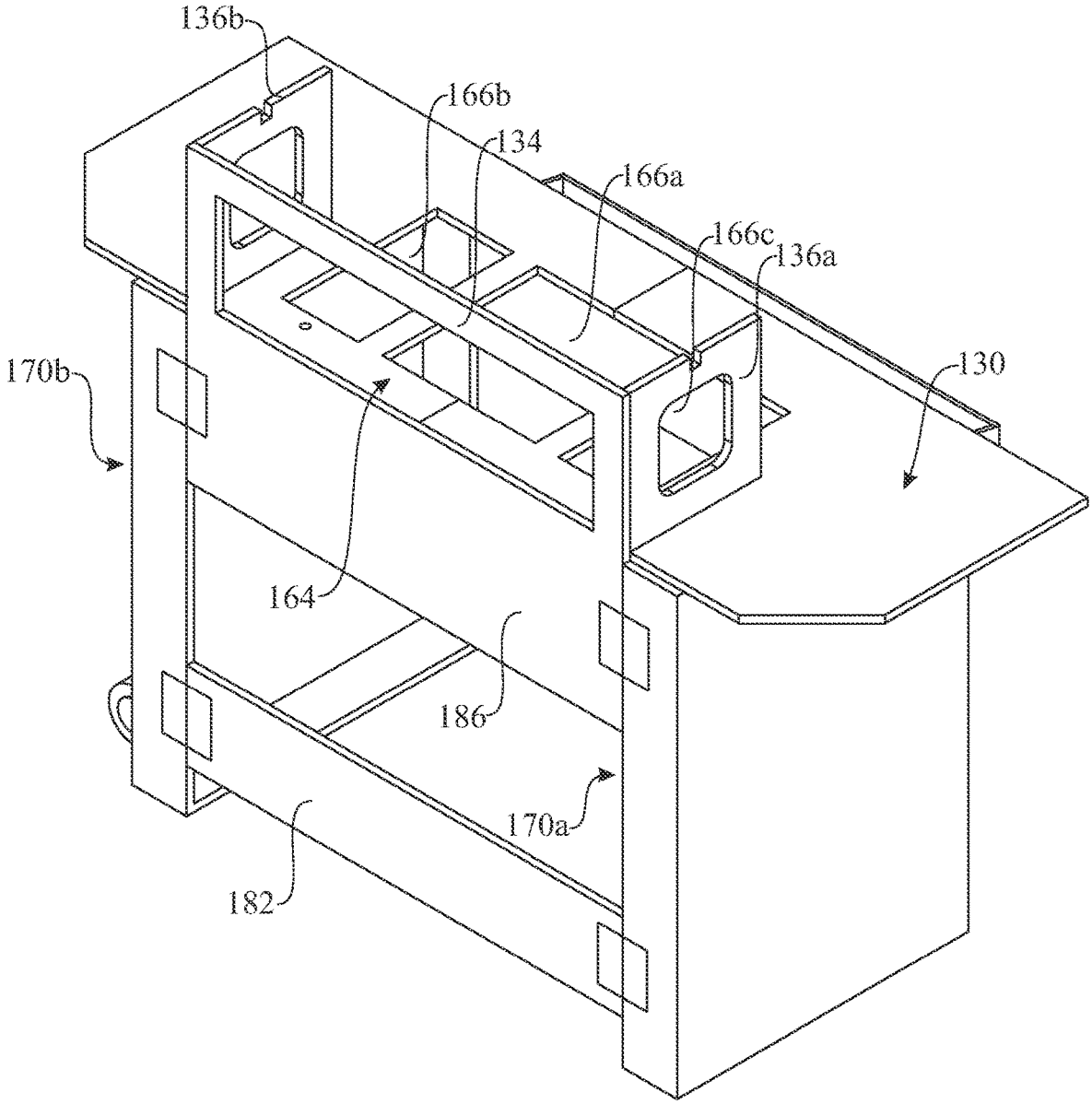
Figure 10G:
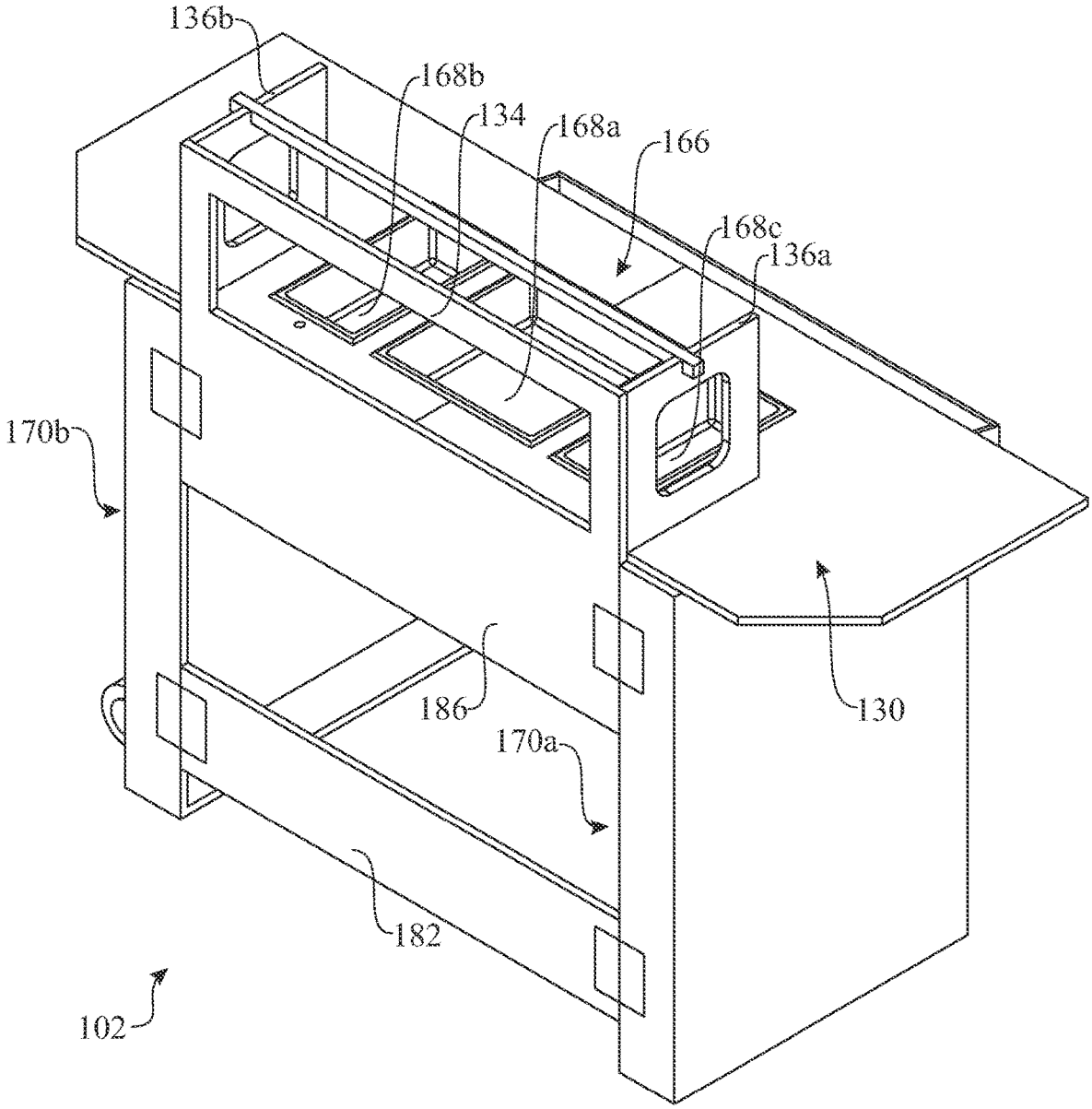

Referring briefly to FIG. 10F, with continuing reference to FIG. 3, the foldable counter top 130 is equipped with a set of centrally located openings or basin-receiving holes 164 formed in the body of counter 130. In one form, for example, the set of counter top openings 164 includes a middle opening 166*a* flanked on both sides by a pair of end openings 166*b,c*. For symmetry purposes and ease of folding, the fold line 148 formed in counter top 130 preferably bisects the middle opening 166*a*. The set of openings 164 formed in counter top 130 individually receive a corresponding set of suitably sized receptacles, compartments, pans or sink-type basins 166 that are disposed in a removable seating relationship within openings 164. In one form, for example, the openings 166*a,b,c* formed in counter top 130 seatingly receive sink-type basins 168*a,b,c*, respectively (FIGS. 3, 9 and 10G). The basin-receiving openings 164 formed in counter top 130 can have any suitable basin-fitting shape, such as rectangular.

Returning to the panel-based frame 108 of bar assembly 100, and referring again to FIGS. 2-3, 9 and 10A-H, the rear panel subassembly 118 disposed at the rear bar area 104 of bar assembly 100 includes a generally planar rear panel 190 extending longitudinally between the pair of support legs 170*a,b* (FIG. 10B). As installed, the rear panel 190 is situated in a vertical plane. The rear panel 190 can be positioned at any location along the height dimension of support legs 170*a,b*. For example, as shown, the rear panel 190 is installed so that its upper edge is generally contiguous or flush with the adjoining rear edge of top side 172*a* of support leg 170*a,b* extending in the same direction. Additionally, the rear panel 190 is installed so that its planar body is generally contiguous or flush with the rear side 176 of support legs 170*a,b*. In particular, the rear panel 190 does not overlap with the support legs 170*a,b* but is positioned in a substantial edge-to-edge abutment relationship.

The rear panel 190 is adapted to releasably support the rear speed rail receptacle 114 (FIG. 10C). Any suitable conventional means well known to those skilled in the art can be used to facilitate the attachment of rear speed rail receptacle 114 to rear panel 190. For example, as shown, a hook mechanism generally illustrated at 192 can be used to hang the rear speed rail receptacle 114 on rear panel 190. In one implementation, the hook mechanism 192 is captured by a hook-receiving aperture formed in the back side of rear speed rail receptacle 114, so that rear speed rail receptacle 114 is maintained in a hanging relationship to rear panel 190. The rear speed rail receptacle 114 has an elongate, rectangular-shaped body defining an open-top container or bin. In addition to providing a means to support the rear speed rail receptacle 114, rear panel 190 provides a firm, stable, and secure brace-type framing means to rigidly connect the pair of support legs 170*a,b* at rear bar area 104.

The rear panel 190 of rear panel subassembly 118 can be releasably fastened, joined or attached to the pair of support legs 170*a,b* by any conventional means well known to those skilled in the art. For example, as shown, a releasable latch mechanism generally illustrated at 169 can be used to fasten the rear panel 190 to the pair of support legs 170*a,b*. More generally, the panel-based frame 108 can be releasably fastened to the pair of support legs 170*a,b* at the front bar area 102 and rear bar area 104, using a corresponding latch mechanism 169. In one implementation, the latch mechanism 169 can use a spring-loaded butterfly draw latch. As shown, one half of the latch mechanism 169 is provided on the rear side 176 of support legs 170*a,b* (FIG. 10A) while the other complementary and mating half of latch mechanism 169 is provided on rear panel 190 of rear panel subassembly 118 (FIG. 10B). During installation, the rear panel 190 is positioned so that it suitably spans between the pair of support legs 170*a,b*, enabling the opposing half sections of latch mechanism 169 to be locked or fastened together.

Referring still to FIGS. 2-3, 9 and 10A-H, the front panel subassembly 116 of frame 108 includes, in combination, a spaced-apart front lower panel 182 (FIG. 10D) and a front upper panel generally illustrated at 184 (FIG. 10E), which together form the front portion of frame 108 at front bar area 102 of bar assembly 100. The front lower panel 182 preferably has a generally planar, solid construction. The front lower panel 182 extends between the pair of support legs 170*a,b* at front bar area 102 and is situated in a vertical plane. The front lower panel 182 can be positioned at any suitable location along the height dimension of support legs 170*a,b*. For example, as shown, the front lower panel 182 is preferably located proximal the foot area of support legs 170*a,b*. In this placement, the front lower panel 182 provides a firm, stable, and secure brace-type framing means to rigidly connect the pair of support legs 170*a,b* at front bar area 102. The front lower panel 182 has a similar orientation relative to the pair of support legs 170*a,b* that rear panel 190 does at rear bar area 104. In particular, front lower panel 182 is installed so that its planar body is generally contiguous or flush with the front side 174 of support legs 170*a,b*. More specifically, the front lower panel 182 does not overlap with the support legs 170*a,b* but is positioned in a substantial edge-to-edge abutment relationship. The front lower panel 182 is releasably attached to support legs 170*a,b* using a set of latch mechanisms 169 organized in the same manner employed to fasten rear panel 190 to support legs 170*a,b* at rear bar area 104.

Referring specifically to FIGS. 9 and 10E, the front upper panel 184 of front panel subassembly 116 at front bar area 102 includes, in combination, a bottom panel portion generally illustrated at 186 and an adjoining top panel portion generally illustrated at 188. The bottom panel portion 186 generally lies below the plane of the deployed and/or installed counter top 130, while the top panel portion 188 generally lies above the plane of counter top 130. The bottom panel portion 186 preferably has a generally planar, solid construction. The bottom panel portion 186 extends between the pair of support legs 170*a,b* at front bar area 102. The bottom panel portion 186 provides a firm, stable, and secure framing means to rigidly connect the pair of support legs 170*a,b* at front bar area 102. The bottom panel portion 186 of front upper panel 184 has a similar orientation relative to the pair of support legs 170*a,b* that the front lower panel 182 does. In particular, bottom panel portion 186 is installed so that its planar body is generally contiguous or flush with the front side 174 of support legs 170*a,b*. More specifically, the bottom panel portion 186 does not overlap with the support legs 170*a,b* but is positioned in a substantial edge-to-edge abutment relationship. The bottom panel portion 186 of front upper panel 184 is releasably attached to support legs 170*a,b* using a set of latch mechanisms 169 organized in the same manner employed to fasten front lower panel 182 to support legs 170*a,b* at front bar area 102. As installed, the front upper panel 184 is situated in a vertical plane.

Referring now to FIGS. 10F-G, with continuing reference to FIGS. 2, 9 and 10E, the top panel portion 188 of the front upper panel 184 of front panel subassembly 116 at front bar area 102 includes, in combination, a main or central panel section 134 and a pair of pivotable, shelf-supporting, end panel sections 136*a,b* that are hingedly attached to central panel section 134 at opposite ends thereof. The pair of end panel sections 136*a,b* can be arranged as vertical spacers or shelf support brackets. During assembly and installation, the pair of end panel sections 136*a,b* pivotably transition from a temporary, intermediate, non-working position (FIG. 10E) to a final, support-ready, working position (FIG. 10F), in which the end panel sections 136*a,b* are pivoted into an orthogonal relationship to central panel section 134. As shown, the end panel sections 136*a,b* lie over the installed counter top 130 (FIGS. 9 and 10F-G). The support-ready positioning of end panel sections 136*a,b* can be maintained by the optional use of a connection member of suitable length extending between and releasably fastened to the pair of end panel sections 136*a,b*, which fixes the end panel sections 136*a,b* in their orthogonal relationship to central panel section 134. The central panel section 134 can be optionally provided with a window or opening to permit direct line-of-sight communication between a bartender present at the rear bar area 104 and a customer present at the front bar area 102.

Figure 10H:
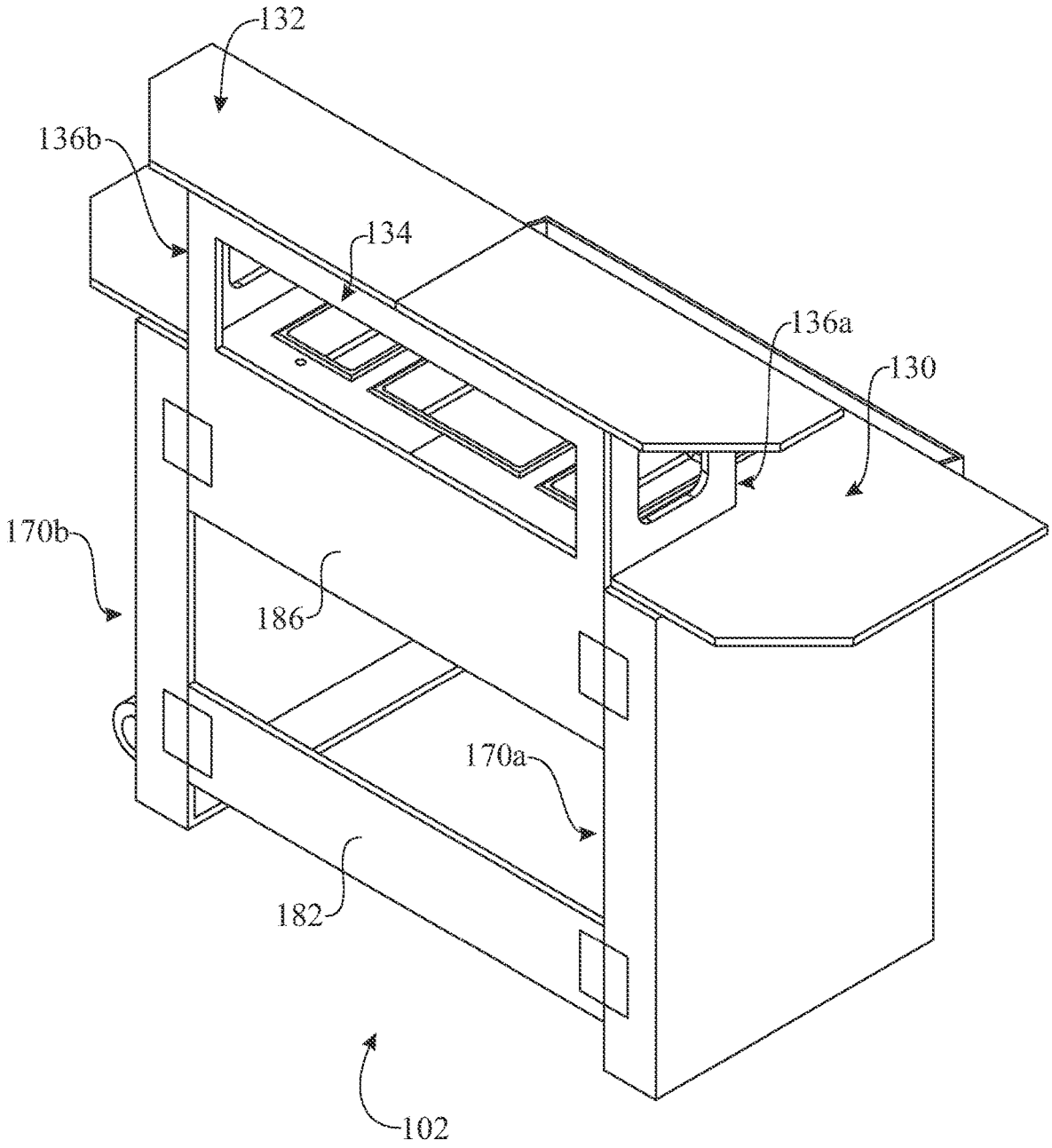

Referring to FIGS. 2, 9 and 10H, after suitable pivoting, the pair of support-ready end panel sections 136*a,b*, receive and support the shelf 132. In this arrangement, the shelf 132 is maintained in a raised, elevated, or spaced-apart relationship to the underlying counter 130 disposed on the pair of support legs 170*a,b*. The shelf 132 spans between the pair of end panel sections 136*a,b* and rests on the upper edge of end panel sections 136*a,b*. The upper edge of the central panel section 134 may also function as a shelf-support surface that cooperates in tandem with the pair of end panel sections 136*a,b* to cooperatively support shelf 132. As shown, the shelf 132 may be sized, shaped and dimensioned to extend past its supports (end panel sections 136*a,b*). Similarly, the counter 130 may be sized, shaped and dimensioned to extend past its supports (support legs 170*a,b*). A releasable fastener arrangement may be optionally employed to secure the installed shelf 132 to the pair of end panel sections 136*a,b*. Similarly, a releasable fastener arrangement may be optionally employed to secure the installed counter 130 to the pair of leg supports 170*a,b*. These counter-securing and shelf-securing fastener arrangements may have any conventional construction well known to those skilled in the art.

Referring to FIG. 2, the body of elevated shelf 132 has a generally planar construction. The shelf 132 includes an edge periphery 150 having a front edge 152 proximal the front bar area 102, a rear edge 154 proximal the rear bar area 104, and a pair of side edges 156*a,b* extending between the front edge 152 and rear edge 154. In one form, the pair of side edges 156*a,b* transition to front edge 152 using a beveled or sloping corner, producing a chamfered profile for side edges 156*a,b*. The shelf 132 further includes a fold line 158 extending between the front edge 152 and rear edge 154 of periphery 150. The fold line 158 is configured to enable shelf 132 to fold into two equal or identical half sections 162*a,b* that lie on one another as a compact unit, making it easy, convenient and space-efficient to store and transport the folded shelf 132. In one form, for symmetry purposes, the fold line 148 of counter 130 and the fold line 158 of shelf 132 lie in a common vertical plane during installation. The central fold line 158 is preferably a midline dividing shelf 132 into two substantially equal parts. As shown in the assembled installations of FIGS. 2-3 and 7, the beveled or sloped corners of the foldable elevated shelf 132 are situated at a frontward location, while the beveled or sloped corners of the foldable counter 130 are situated at a rearward location. This depiction is merely illustrative and should not be considered in limitation of the present invention, as other arrangements are possible. For example, in order to promote symmetry and aesthetics, the shelf 132 and counter 130 would be suitably constructed so that both of these components, as assembled, have the same orientation for their respective beveled corners, i.e., the beveled corners are all at a forward location or all at a rearward location. In a preferred arrangement, the respective beveled corners of shelf 132 and counter 130 are disposed at a forward (frontward) location, such as presently depicted with shelf 132.

Referring now to FIGS. 2-5, the water supply subassembly 120 of bar assembly 100 includes, in combination, a water receptacle 122, a pump 124, an inlet hose 126, and an outlet hose 128. The water supply subassembly 120 is situated at a convenient location under the counter 130 between the spaced-apart support legs 170*a,b*. The water receptacle 122 can be any suitable water-holding container. The inlet hose 126 is configured to provide a water communication path between the water receptacle 122 and pump 124, while outlet hose 128 is configured to provide a water communication path between pump 124 and a faucet 138 installed for use with one of the sink-defining basins 166 situated with counter 130 (e.g., basin 168*b*). The pump 124 can be provided in any suitable form well known to those skilled in the art. In one form, for example, the pump 124 is implemented as a manually-driven, foot-powered pump device that is actuated by the user (bartender) applying repeated pressure to a foot pedal. During operation, as the bartender actuates pump 124 by pushing on the foot pedal, a suction action is created that draws water from water receptacle 122, conveys the pumped fluid through inlet hose 126 to pump 124, and then continues the pumped water flow through outlet hose 128 to the overhead faucet 138. The pumping action afforded by pump 124 is sufficient to allow the pumped water flow to overcome the resistance due to gravity and travel the generally vertical or upwards pathway through outlet hose 128 to faucet 138, delivering water into basin 168*b*. The combination of water-delivering faucet 138 and its associated basin 168*b* effectively operates as a portable sink, due to the overall portability of bar assembly 100. Any type of suitable conventional faucet 138 can be used, as well known to those skilled in the art. For example, faucet 138 can be equipped with a swivel feature to allow it pivot and direct water into different areas of the sink-type basin. Additionally, faucet 138 can be adapted as a retractable device that can be withdrawn, maneuvered about, and returned to its stowed position.

The manually-driven pump 124 is advantageous because it does not require any electrical powering such as a hook-up to onsite electrical outlets. This lack of connection to the power grid facilitates the self-sustaining and self-maintaining feature of bar assembly 100. The manually-driven pump 124 is even superior to a battery-operated pump, which though it may provide some level of self-sufficiency, is a consumable resource and will eventually exhaust and require recharging. A manually-driven pump requires no ordinary maintenance and can operate perpetually without interruption or renewal. The water supply subassembly 120 is a fully self-contained unit capable of independent operation not reliant on any external resources or assets. The user only needs to access the local water supply to fill the water receptacle 122; otherwise, the water supply subassembly 120 is fully self-sufficient. The user merely needs to refill the water receptacle 122 if the water is exhausted from consumption (i.e., use by faucet 138). No hydraulic connection to the local water supply is required. The user can control and/or regulate the level of water flow by adjusting the level of actuation of pump 124.

Figure 8:
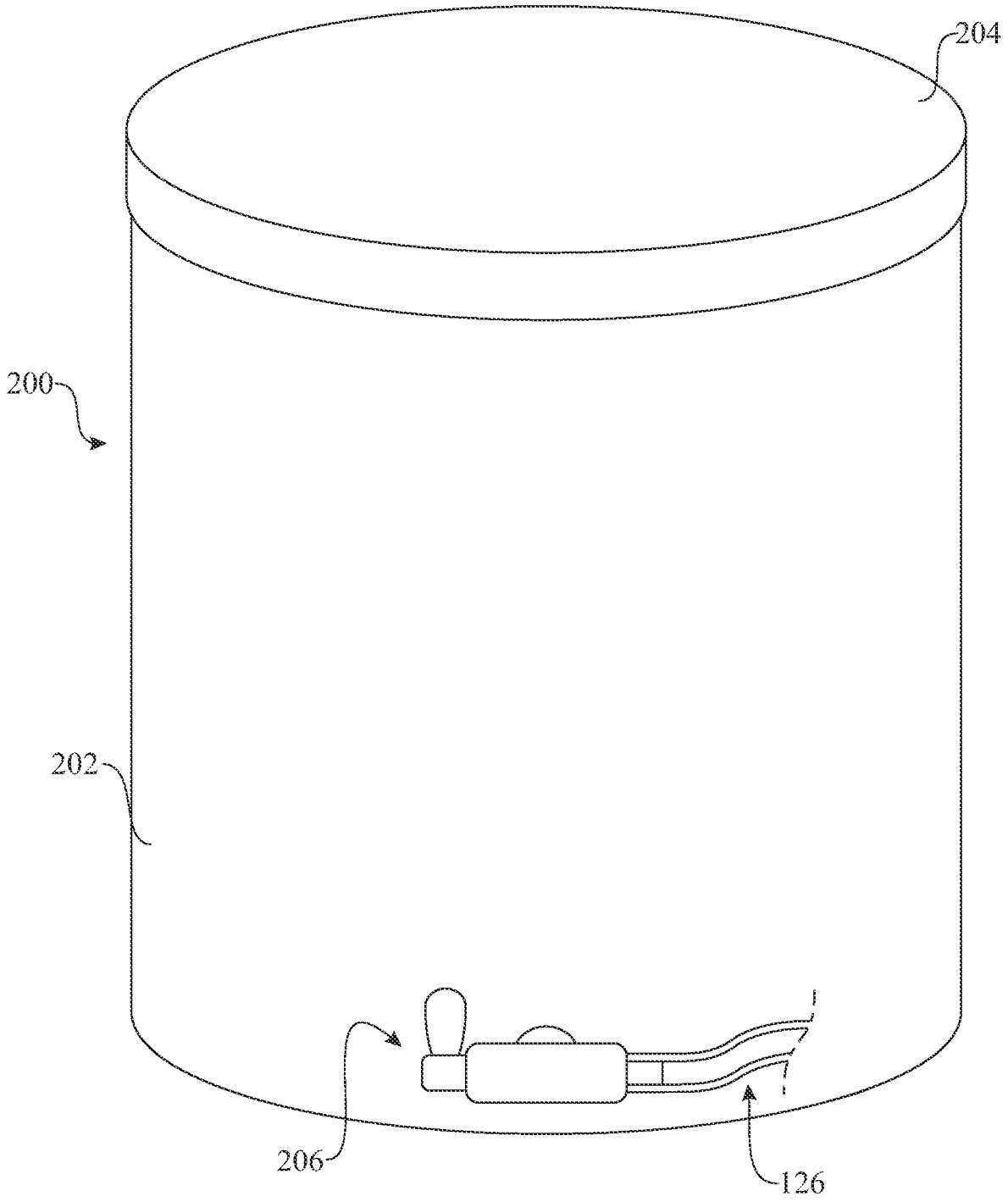
FIG. 8 presents an upper, lateral elevation view of an alternative water supply system for use with the bar assembly shown in FIGS. 2-3 and 5.

Referring to FIG. 8, an alternate water receptacle assembly 200 can be used in place of water receptacle 122. The water receptacle assembly 200 includes a water-holding container 202 having a cylindrical body, and a removable lid 204. The container 202 can be provided in any suitable size, shape and dimension well known to those skilled in the art. The assembly 200 further includes a valve device generally illustrated at 206 to control the fluid access between water inlet line 126 and the fluid contents of container 202. In this way, when container 202 needs to be refilled, the user can place the valve device 206 into a shut-off mode (close valve) and then disconnect inlet line 126 from valve device 206, allowing container 202 to be removed from the area of bar assembly 100 and carried to the local water supply to replenish the water.

Figure 11:
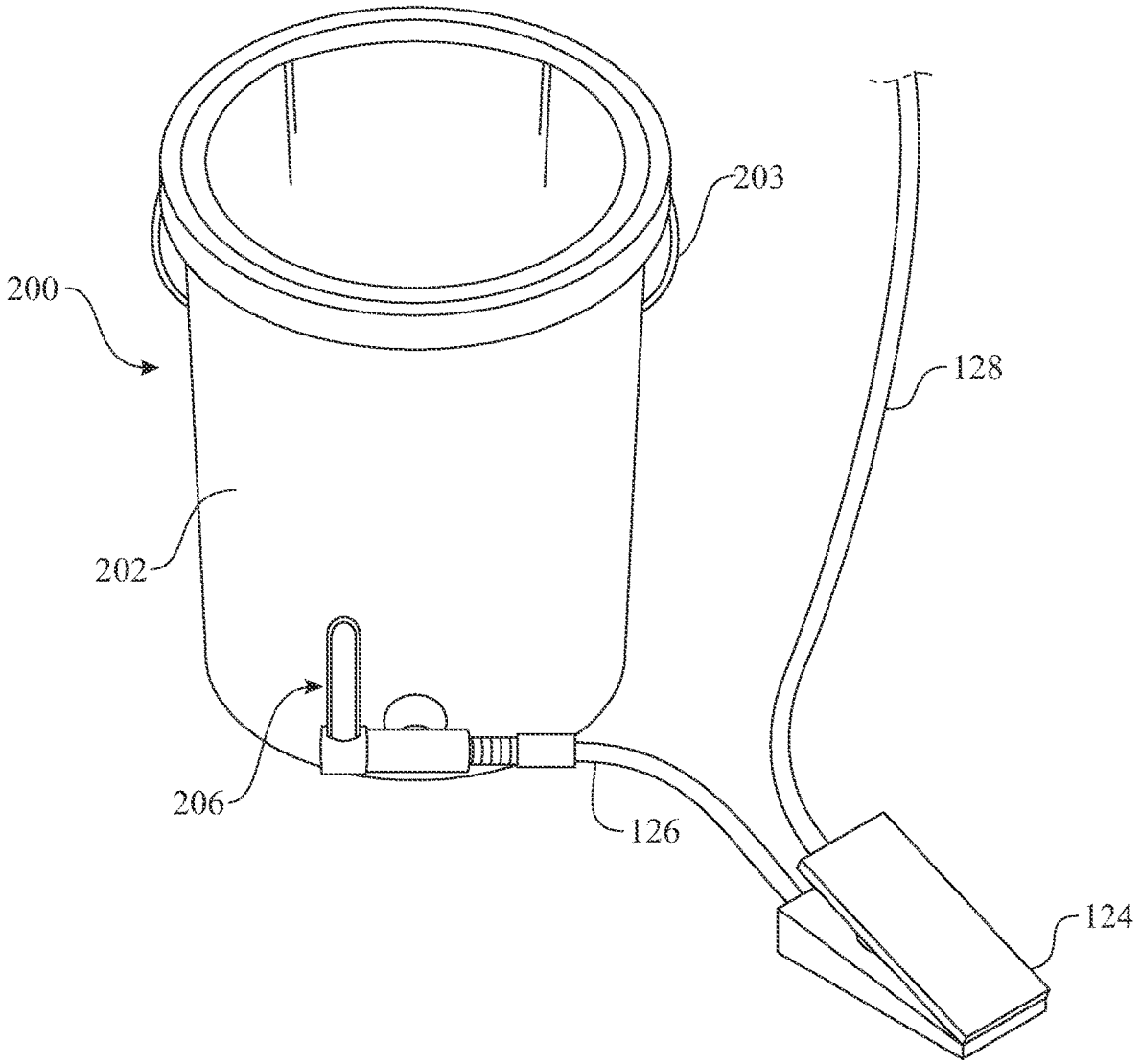

Referring to FIG. 11, there is provided a bucket version of the alternate water receptable assembly 200, such as that shown in FIG. 8. As noted above, the bucket version of the water receptacle assembly 200 includes a water-holding container 202, i.e., a bucket container, having a cylindrical body and a handle 203. The container 202 can be provided in any suitable size, shape and dimension well known to those skilled in the art. As noted above, the assembly 200 further includes a valve device generally illustrated at 206 to control the fluid access between water inlet line 126 and the fluid contents of container 202. In this way, when container 202 needs to be refilled, the user can place the valve device 206 into a shut-off mode (close valve) and then disconnect inlet line 126 from valve device 206, allowing the bucket container 202 to be removed from the area of bar assembly 100 and carried to the local water supply to replenish the water.

Figure 12:
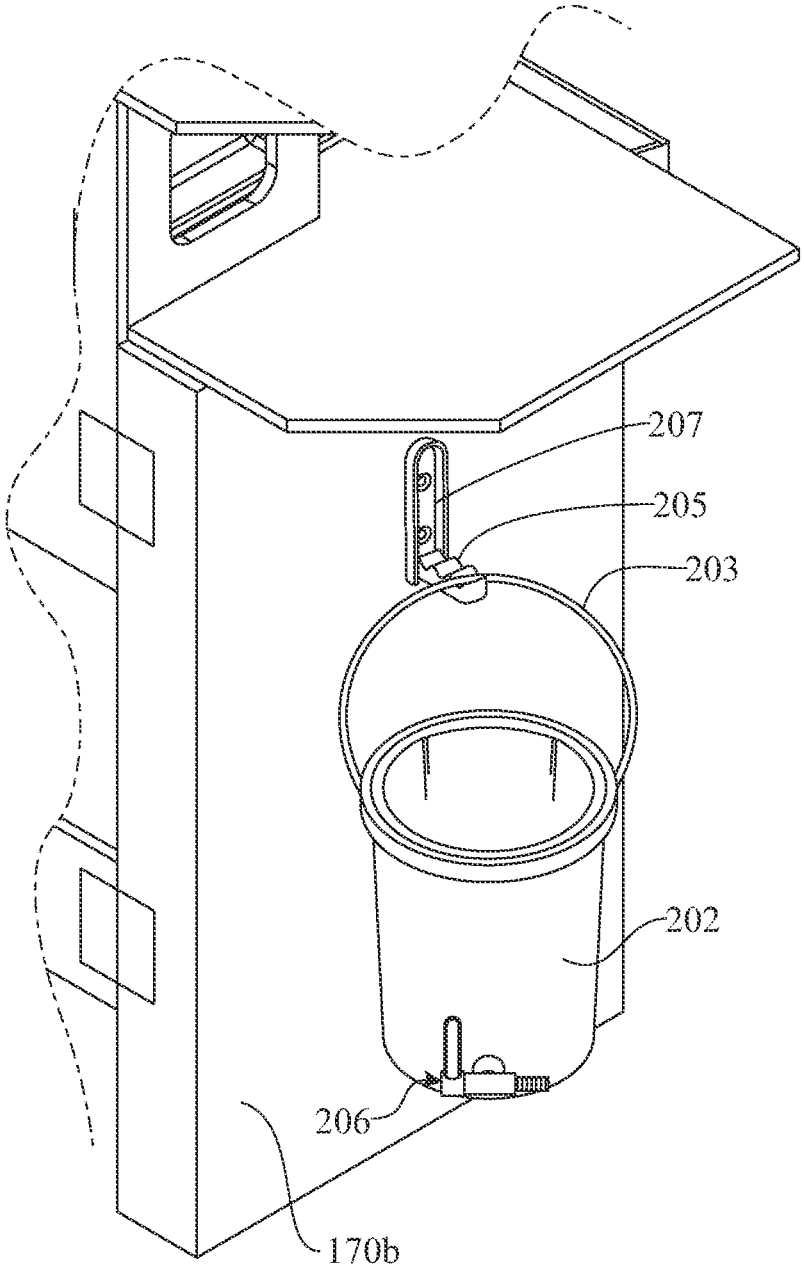
FIG. 12, is a view of the placement of the alternative water supply container of FIG. 11 on a hook on the side of the bar assembly.

Referring to FIG. 12, the bucket version of the alternate water receptacle assembly 200 shown in FIG. 8 or FIG. 11, can be hung on a collapsible handle or hook 205, which can be affixed (e.g., with fasteners) to either of the support legs 170*ab*, preferably by use of a bracket 207. The bucket version of the alternate water receptacle assembly 200 can be hung on the collapsible handle or hook to provide for the easy transport of the whole unit.

Referring to FIG. 6, the deployed bar assembly 100 can be equipped with various optional items and accessories. In one form, the bar assembly 100 can include a set of dispensers 194 dispensing various liquids via individual dispenser 196. For example, the dispensers 194 can individually dispense flavored liquids useful for making cocktails, such as lime, lemon, and basic syrup. The individual dispenser 196 can be provided in any conventional form. For example, the dispenser 196 can have a button that the user depresses to dispense fluid in a measurable, metered fashion (e.g., every 2 second hold equals a quarter ounce of fluid). The set of dispensers 194 are preferably attached as a unit to the rear edge side of elevated shelf 132 at the rear bar area 104, making it easily accessible to the bartender.

Referring to FIG. 7, the fully operational bar assembly 100 has a layout and inventory compatible with a traditional, fixed bar structure, making it convenient and efficient for a bartender manning bar assembly 100 at the rear bar area 104 to provide a full-service bartending experience to a customer or patron present on the other side of the bar at front bar area 102. The bar assembly 100 can be stocked with an assortment of bottles (beer and liquor), materials, and other supplies. For example, the rear speed rail receptacle 114 hanging from rear panel 190 can be stocked with a collection of commonly requested liquor bottles 10, making these items easily and quickly accessible to the bartender. Both ends of counter 130 can accommodate an additional collection of supplies 12 (e.g., cups, glasses, bottles, trays filled with garnishes). Additionally, the elevated shelf 132 can accommodate a further collection of items 14 (e.g., bottles, cups and glasses). The pan-type basins 166 can also be put to use. For example, one of the basins 166 can be filled with ice cubes 16. The stocked bar assembly 100 is able to provide a full-service beverage operation, including, but not limited to, cocktails, mixed drinks, beer, wine, non-alcoholic beverages (e.g., soda, juice, water), and other refreshments typical of bartending service. The faucet 138 can be used as needed in conjunction with the water supply subassembly 120, e.g., to wash hands, to clean bowls, glassware, utensils). The load capacity of the deployed bar assembly 100 can be varied by adjusting the material construction of the various components, especially the counter 130, shelf 132, pair of support legs 170*a,b*, and frame 108 (front panel subassembly 116 and rear panel subassembly 118).

Referring to FIG. 1, the fully deployed bar assembly 100 can be disassembled by reversing the series of setup operations shown in FIGS. 10A-H. Once the bar assembly 100 is disassembled up to the point shown in FIG. 10A, the pair of open-sided, rectangular-shaped, crate-like, box-type support legs 170*a,b* are made available as the pair of half sections forming case 106. Following removal, all of the remaining components of bar assembly 100 are stowed within the storage enclosure space defined by case 106, with the exception of water supply subassembly 120, which is stored and carried separately. During disassembly, the counter top 130 is folded at its fold line 148 into overlying half sections 160*a,b*. Similarly, the shelf 132 is folded at its fold line 158 into overlying half sections 162*a,b*. The folded counter top 130 and folded shelf 132 are placed in case 106. The entire panel-based frame 108 is loaded into case 106. From the rear bar area 104, the rear panel 190 of rear panel subassembly 118 is removed and placed in case 106. From the front bar area 102, the front upper panel 184 and the front lower panel 182 of front panel subassembly 116 are removed and placed as discrete components in case 106. In the top portion 188 of front upper panel 184, the pair of pivotable shelf-support end panel sections 136*a,b* are pivoted inwards to lie flush against the central panel section 134, prior to loading in case 106. Miscellaneous loose articles can be loaded into case 106, including the rear speed rail receptacle 114, the set of sink-type basins or bins 166, the set of liquid dispensers 194, and the removable faucet 138. Once case 106 is loaded with the bar assembly contents, the case 106 can be releasably locked and secured using the same latch mechanisms 169 used to fasten the panel-based frame 108 to the pair of support legs 170*a,b*.

The case 106 can be rendered portable and mobile by equipping one of the support legs 170*b* with a set of wheels 199*a,b* and a suitable handle 198. In this way, for transport purposes, the user can grasp handle 198 and then tilt the case 106 back so that wheels 199*a,b* contact the ground. The wheeled case 106 can now be drawn or rolled around in the manner of a wheeled suitcase. The bar assembly 100 has a modular construction that is easily collapsible into a number of components sufficiently compact to fit inside case 106. For example, the counter 130 and shelf 132 are both individually foldable into a compact size readily packed and stored in case 106. The panels of frame 108 easily fit into case 106. For example, the hinged connection of the shelf-supporting, end panel sections 136*a,b* to central panel section 134 makes this part of the front upper panel 184 easy to consolidate into a more compact unit readily loaded into case 106. The contents of loaded case 106 remain safe and secure during transit. At the next venue or destination, the loaded case 106 is unpacked and the bar assembly 100 is re-assembled and deployed following the set of operations disclosed in FIGS. 10A-H. The case 106 can be transported in any number of ways, included wheeled travel and vehicle carriage.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A bar assembly, comprising:

a front bar area and a rear bar area;

a pair of support legs;

a foldable counter removably disposed on the pair of support legs;

a frame including a front portion disposed at the front bar area and a rear portion disposed at the rear bar area, the front portion and the rear portion of the frame each removably extending at least in part between the pair of support legs;

a foldable elevated shelf disposed over the counter and supported by the front portion of the frame; and a rear speed rail receptacle disposed at the rear bar area and removably supported by the rear portion of the frame;

wherein the bar assembly is operable to adopt a disassembled and stowed configuration in which the pair of support legs define respective joinable half sections cooperatively forming a selectively openable and closable case defining an enclosure space, and in which the case carries as discrete items in the enclosure space at least one of the folded counter, the folded shelf, the frame, and the rear speed rail receptacle, and wherein the front panel subassembly includes a lower panel and an upper panel and wherein the upper panel of the front panel subassembly includes a top section extending at least in part above the counter and an adjoining bottom section extending at least in part below the counter and wherein the top section includes, in combination, a central panel having an opening, and a pair of pivotable wing panels hingedly joined to the central panel at respective ends thereof.

2. The bar assembly of claim 1, wherein the front bar area defines a location accessible by a customer seeking bartending service, and the rear bar area defines a location capable of being manned by a bartender offering the bartending service.

3. The bar assembly of claim 1, wherein the frame defines a front panel subassembly, and the rear portion of the frame defines a rear panel subassembly.

4. The bar assembly of claim 1, wherein the rear portion of the frame includes a panel.

5. The bar assembly of claim 1, wherein, the pair of pivotable wing panels of the top section of the upper panel of the front panel subassembly support the foldable elevated shelf.

6. The bar assembly of claim 1, wherein, each support leg includes, in combination, an opposing top side and a bottom side; an opposing front side and a rear side each extending between the top side and the bottom side; an outer side extending between the top side and the bottom side and further extending between the front side and the rear side; and, an inner-side opening disposed opposite and facing the outer side.

7. The bar assembly of claim 1, wherein each support leg defines an open-sided, rectangular-shaped enclosure.

8. The bar assembly of claim 1, wherein, one of the support legs includes a wheel arrangement.

9. The bar assembly of claim 1, wherein, one of the support legs includes a handle.

10. The bar assembly of claim 1, wherein the foldable counter includes a periphery having a front edge, a rear edge, and a pair of side edges extending between the front edge and the rear edge.

11. The bar assembly of claim 10, wherein the foldable counter includes a fold line extending between the front edge and the rear edge of the periphery thereof to define half sections of the foldable counter that are pivotable relative to one another.

12. The bar assembly of claim 11, wherein the foldable counter includes at least one basin-receiving opening formed in the foldable counter.

13. The bar assembly of claim 12, wherein the at least one basin-receiving opening formed in the foldable counter includes a middle opening and a pair of end openings formed on opposite sides of the middle opening.

14. The bar assembly of claim 13, wherein, the fold line of the foldable counter bisects the middle opening of the at least one basin-receiving opening formed in the foldable counter.

15. The bar assembly of claim 13, wherein the bar assembly includes at least one basin each removably received by a respective one of the at least one basin-receiving opening formed in the foldable counter.

16. The bar assembly of claim 10, wherein, the pair of side edges of the foldable counter each transitions to the rear edge using a beveled corner.

17. The bar assembly of claim 1, further comprising a water supply subassembly including a water-holding receptacle and a pump system configured to communicate water from the water-holding receptacle to a faucet.

18. A bar assembly, comprising:

a front bar area and a rear bar area;

a pair of support legs;

a foldable counter removably disposed on the pair of support legs;

a frame including a front portion disposed at the front bar area and a rear portion disposed at the rear bar area, the front portion and the rear portion of the frame each removably extending at least in part between the pair of support legs;

a foldable elevated shelf disposed over the counter and supported by the front portion of the frame; and a rear speed rail receptacle disposed at the rear bar area and removably supported by the rear portion of the frame;

wherein the bar assembly is operable to adopt a disassembled and stowed configuration in which the pair of support legs define respective joinable half sections cooperatively forming a selectively openable and closable case defining an enclosure space, and in which the case carries as discrete items in the enclosure space at least one of the folded counter, the folded shelf, the frame, and the rear speed rail receptacle and wherein, the foldable counter includes a periphery having a front edge, a rear edge, and a pair of side edges extending between the front edge and the rear edge and wherein, the foldable counter includes a fold line extending between the front edge and the rear edge of the periphery thereof to define half sections of the foldable counter that are pivotable relative to one another.

19. A bar assembly, comprising:

a front bar area and a rear bar area;

a pair of support legs;

a foldable counter removably disposed on the pair of support legs;

a frame including a front portion disposed at the front bar area and a rear portion disposed at the rear bar area, the front portion and the rear portion of the frame each removably extending at least in part between the pair of support legs;

a foldable elevated shelf disposed over the counter and supported by the front portion of the frame; and a rear speed rail receptacle disposed at the rear bar area and removably supported by the rear portion of the frame;

wherein the bar assembly is operable to adopt a disassembled and stowed configuration in which the pair of support legs define respective joinable half sections cooperatively forming a selectively openable and closable case defining an enclosure space, and in which the case carries as discrete items in the enclosure space at least one of the folded counter, the folded shelf, the frame, and the rear speed rail receptacle, and wherein the rear speed rail receptacle is a longitudinal box having an inner longitudinal side having a height greater than an opposing outer longitudinal side and two width sides connecting the inner longitudinal side and the outer longitudinal side which two width sides each have a top edge which tapers from its connection from the inner longitudinal side to the outer longitudinal side.

* * * * *